US009901791B2

(12) United States Patent
Mizutani et al.

(10) Patent No.: US 9,901,791 B2
(45) **Date of Patent: *Feb. 27, 2018**

(54) GOLF CLUB HEAD

(71) Applicant: DUNLOP SPORTS CO. LTD., Kobe-shi, Hyogo (JP)

(72) Inventors: Naruhiro Mizutani, Kobe (JP); Hiroshi Abe, Kobe (JP); Daisuke Kohno, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 147 days.

This patent is subject to a terminal disclaimer.

(21) Appl. No.: 14/979,964

(22) Filed: Dec. 28, 2015

(65) Prior Publication Data

US 2016/0184666 A1 Jun. 30, 2016

(30) Foreign Application Priority Data

Dec. 25, 2014 (JP) ..... 2014-262578
Jun. 10, 2015 (JP) ..... 2015-117883

(51) Int. Cl.
*A63B 53/08* (2015.01)
*A63B 53/04* (2015.01)
*A63B 60/02* (2015.01)

(52) U.S. Cl.
CPC ..... *A63B 53/0466* (2013.01); *A63B 53/08* (2013.01); *A63B 60/02* (2015.10);
(Continued)

(58) Field of Classification Search
CPC .... A63B 2053/0416; A63B 2053/0437; A63B 2053/045; A63B 2053/0454;
(Continued)

(56) References Cited

U.S. PATENT DOCUMENTS 7,303,488 B2 * 12/2007 Kakiuchi ..... A63B 53/0466 473/345
2004/0043833 A1 * 3/2004 Galloway ..... A63B 53/02 473/345

(Continued)

FOREIGN PATENT DOCUMENTS

JP 2004-167115 A 6/2004
JP 2005-6698 A 1/2005
JP 2005-168665 A 6/2005
JP 2012-75827 A 4/2012

(Continued)

OTHER PUBLICATIONS

Japanese Office Action issued in 2015-117883, dated Sep. 1, 2015, (with translation).

*Primary Examiner* — Benjamin Layno
(74) *Attorney, Agent, or Firm* — Birch, Stewart, Kolasch & Birch, LLP

(57) ABSTRACT

A golf club according to the present invention includes a golf club head body that has a crown portion and a sole portion and has an opening surrounded by the crown portion and the sole portion, and a face member that covers the opening of the golf club head body. The face member is formed in the shape of a cup having a face portion formed in a plate shape and a peripheral portion that extends from the peripheral edge of the face portion. In the peripheral portion of the face member, the portion that extends along the crown portion includes a first toe-side edge portion arranged on the toe side, a first heel-side edge portion arranged on the heel side, and a first central edge portion arranged between the first toe-side edge portion and the first heel-side edge portion.

9 Claims, 11 Drawing Sheets

(52) U.S. Cl.
CPC . *A63B 2053/045* (2013.01); *A63B 2053/0408* (2013.01); *A63B 2053/0412* (2013.01); *A63B 2053/0416* (2013.01); *A63B 2053/0433* (2013.01); *A63B 2053/0437* (2013.01); *A63B 2053/0454* (2013.01); *A63B 2053/0458* (2013.01); *A63B 2053/0462* (2013.01)

(58) Field of Classification Search
CPC .... A63B 2053/0458; A63B 2053/0462; A63B 53/08; A63B 53/0466
USPC ..... 473/342, 349, 346, 345, 329
See application file for complete search history.

(56) References Cited

U.S. PATENT DOCUMENTS

| | | | | |
|---|---|---|---|---|
| 2005/0026722 | A1* | 2/2005 | Imamoto | A63B 53/04 473/345 |
| 2005/0124436 | A1 | 6/2005 | Kakiuchi et al. | |
| 2013/0331203 | A1* | 12/2013 | Takahashi | A63B 53/0466 473/345 |
| 2014/0213389 | A1 | 7/2014 | Yamamoto | |
| 2014/0274462 | A1* | 9/2014 | Sander | A63B 53/0466 473/345 |
| 2015/0045147 | A1 | 2/2015 | Abe | |
| 2016/0184664 | A1* | 6/2016 | Mizutani | A63B 53/0466 473/345 |

FOREIGN PATENT DOCUMENTS

| | | | |
|---|---|---|---|
| JP | 2014-147488 | A | 8/2014 |
| JP | 2015-33463 | A | 8/2014 |

* cited by examiner (a)

(b)

E1Cross-section

GOLF CLUB HEAD

TECHNICAL FIELD

The present invention relates to a golf club head.

BACKGROUND ART

Many improvements have conventionally been made to wood-type golf club heads, and particularly in the case of drivers, various proposals have been made for extending the flight-distance. For example, as shown in JP 2005-6698A, some golf club heads employ a face portion having a so-called cup face structure. Specifically, the head is constituted by a head body having an opening formed therein and a face member that covers the opening of the head body, and the face member is formed in the shape of a cup having a plate-shaped face portion and a peripheral portion that extends from the peripheral edge of the face portion. Providing such a peripheral portion on the face member increases the amount of flexure of the face member when hitting a ball, thus obtaining effects of improving the restitution performance and extending the flight-distance.

In particular, in the golf club head disclosed in JP 2005-6698A, the restitution performance is improved by adjusting the wall thickness of the crown portion. Specifically, the wall thickness of the crown portion of the head body is set lower than the wall thickness of the opposing peripheral portion of the face member. Also, in the peripheral portion of the face member, the portion that opposes the crown portion of the head body has a shorter length of protrusion from the base portion of the peripheral portion in the central portion in the toe-heel direction, whereas the portions on the two sides thereof, namely the toe side and the heel side, have longer protruding lengths. In other words, a recessed portion is formed in the vicinity of the center of the peripheral portion. A protruding portion is correspondingly formed in the vicinity of the center of the crown portion, and fits into the recessed portion of the peripheral portion in the opening of the head body. Accordingly, the area of the portion with a low wall thickness increases in the vicinity of the center of the crown portion, and the restitution performance improves. On the other hand, the area of the portion with a high wall thickness increases on the toe side and the heel side of the crown portion in accordance with the peripheral portion, and therefore durability improves.

SUMMARY OF INVENTION

However, although the restitution performance improves in the vicinity of the center of the toe-heel direction with this structure, there is room for improvement in the restitution performance on the toe side and the heel side. The present invention was achieved in order to resolve this problem, and an object thereof is to provide a golf club head that employs a cup face structure and also enables improving the restitution performance on the toe side and the heel side.

Invention A

A golf club according to an aspect of the present invention includes: a golf club head body having a crown portion and a sole portion, and having an opening surrounded by the crown portion and the sole portion; and a face member that covers the opening of the golf club head body, wherein the face member is shaped as a cup having a face portion formed in a plate shape and a peripheral portion extending from a peripheral edge of the face portion, a portion of the peripheral portion of the face member that extends along the crown portion includes a first toe-side edge portion arranged on a toe side, a first heel-side edge portion arranged on a heel side, and a first central edge portion arranged between the first toe-side edge portion and the first heel-side edge portion, a length of protrusion of the first central edge portion from the face portion is shorter than a length of protrusion of the first toe-side edge portion and the first heel-side edge portion from the face portion, a thickness of at least a portion of the first central edge portion is larger than a thickness of the first toe-side edge portion and the first heel-side edge portion, and a protruding portion extending along the opening is formed on the crown portion of the golf club head body for joining to the first central edge portion.

In the above golf club head, an opening-side edge portion of the crown portion of the golf club head body may include a second toe-side edge portion, a second heel-side edge portion, and a second central edge portion for joining to the first toe-side edge portion, the first heel-side edge portion, and the first central edge portion respectively, and a thickness of at least a portion of the second central edge portion may be larger than a thickness of the second toe-side edge portion and the second heel-side edge portion.

In the above golf club head, the thickness may progressively decrease from the first central edge portion to the first toe-side edge portion and the first heel-side edge portion.

In the above golf club head, the thickness may progressively decrease from the first and second central edge portions to the first and second toe-side edge portions and the first and second heel-side edge portions.

In the above golf club head, thicknesses of the first and second toe-side edge portions may be the same, thicknesses of the first and second heel-side edge portions may be the same, and thicknesses of the first and second central edge portions may be the same.

In the above golf club head, the crown portion may include a peripheral edge region that extends along an inner peripheral edge of the crown portion, and an inner region surrounded by the peripheral edge region, and a thickness of at least a portion of the inner region may be smaller than a thickness of the peripheral edge region.

In the above golf club head, a first region and a plurality of second regions having a smaller thickness than the first region may be provided in the inner region, the plurality of second regions may be distributed so as to radiate toward a peripheral portion of the crown portion excluding the face side in the face-back direction, from respective origins that are located in a vicinity of a face side in a face-back direction in a range of within 35 mm from a center of gravity of the golf club head as a center in a toe-heel direction in a plan view, and portions of the first region arranged between adjacent second regions may increase in width from the origin side toward the peripheral portion side.

In the above golf club head, a portion of the peripheral edge region that opposes the first heel-side edge portion may have a longer length in the face-back direction with increasing proximity to the heel side.

In the above golf club head, a portion of the peripheral edge region that opposes the first toe-side edge portion may have a longer length in the face-back direction with increasing proximity to the toe side.

According to the present invention, it is possible to employ a cup face structure and also suppress a reduction on restitution performance on the toe side and the heel side.

Invention B

Conventionally, various attempts have been made to improve the restitution factor of the face portion of golf club heads in order to extend the flight-distance of a hit ball. In order to raise the restitution factor of the face portion, it is effective to reduce the rigidity of the face portion itself and portions peripheral thereto. JP 2005-6698A discloses that among the portions peripheral to the face portion, in the front edge portion of the crown portion in particular, lowering the rigidity in the central portion in the toe-heel direction is effective in improving the restitution performance.

However, the restitution factor needs to be kept at a standard value or lower in order to comply with golf competition rules. Also, besides the case of hitting the ball with the central region of the face portion, there is demand for an extension of the flight-distance also for the case where the ball is not hit with the central region, that is to say during a mishit or an intentional shot. For this reason, there are cases where the area with a high restitution factor needs to be enlarged.

The present invention was achieved in light of this, and an object thereof is to provide a golf club head that includes a face portion having an enlarged high restitution area.

A golf club head according to a first aspect of the present invention includes: a head body with a hollow structure having a crown portion, a sole portion, and a side portion, and having an opening on a front side; and a cup face having a face portion configured to hit a ball and a rising portion that extends rearward from a peripheral edge of the face portion, and being connected to the head body so as to cover the opening on the front side of the head body. A front edge portion of the crown portion has a first toe-side portion on a toe side, a first heel-side portion on a heel side, and a first central portion located between the first toe-side portion and the first heel-side portion, and the first central portion is formed in a protruding shape that protrudes forward. The rising portion has an upper rising portion that is connected to the front edge portion of the crown portion. The upper rising portion has a second toe-side portion that is connected to the first toe-side portion and a second heel-side portion that is connected to the first heel-side portion, and the second toe-side portion and the second heel-side portion are formed in a protruding shape that protrudes rearward. The first central portion has a higher rigidity than the first heel-side portion and the first toe-side portion.

A golf club head according to a second aspect of the present invention is the golf club head according to the first aspect, wherein one or more ribs are formed on the first central portion.

A golf club head according to a third aspect of the present invention is the golf club head according to the second aspect, wherein the one or more ribs extend in a face-back direction.

A golf club head according to a fourth aspect of the present invention is the golf club head according to any of the first to third aspects, wherein the first central portion is formed with a larger thickness than the first toe-side portion and the first heel-side portion.

A golf club head according to a fifth aspect of the present invention is the golf club head according to any of the first to fourth aspects, wherein letting w1 be the thickness of the upper rising portion, and w2 be the thickness of a front edge portion of the crown portion, a relationship w1>w2−1 mm is satisfied.

A golf club head according to a sixth aspect of the present invention is the golf club head according to any of the first to fifth aspects, wherein the upper rising portion further has a second central portion that is located between the second toe-side portion and the second heel-side portion and is connected to the first central portion, and the second toe-side portion and the second heel-side portion protrude rearward of the second central portion.

According to the first aspect, a cup face structure is employed. In this case, the face portion flexes easily overall, and the restitution factor improves. This is because the connection portion of the face member and the head body (often the welded portion), where rigidity tends to increase, moves rearward of the face portion (face surface). Also, according to the first aspect, the central portion of the front edge portion of the crown portion (first central portion) protrudes toward the face portion more than the portion on the heel side (first heel-side portion) and the portion on the toe side (first toe-side portion). For this reason, in the face portion, it is possible to relatively improve the restitution factor in this peripheral region. Furthermore, according to the first aspect, the rigidity of the first central portion is higher than the first heel-side portion and the first toe-side portion. Accordingly, it is possible to suppress the restitution factor in the central region of the face portion. As a result, it is possible to increase the restitution factor in the heel-side and toe-side portions of the face portion, while also adhering to golf competition rules related to the restitution factor. As described above, according to the first aspect, it is possible to increase the restitution factor not only in the central region in the face portion, but also in the heel-side portion and the toe-side portion, and it is possible to enlarge the high restitution area.

DESCRIPTION OF EMBODIMENTS

A. First Embodiment

Figure 1:
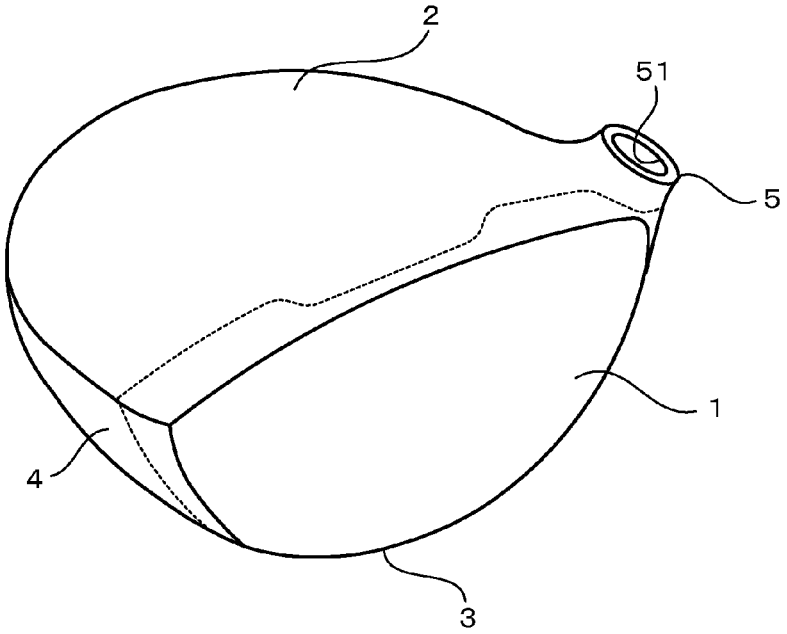
FIG. 1 is a perspective view of a reference state of a golf club head according to a first embodiment of the present invention.
Figure 2:
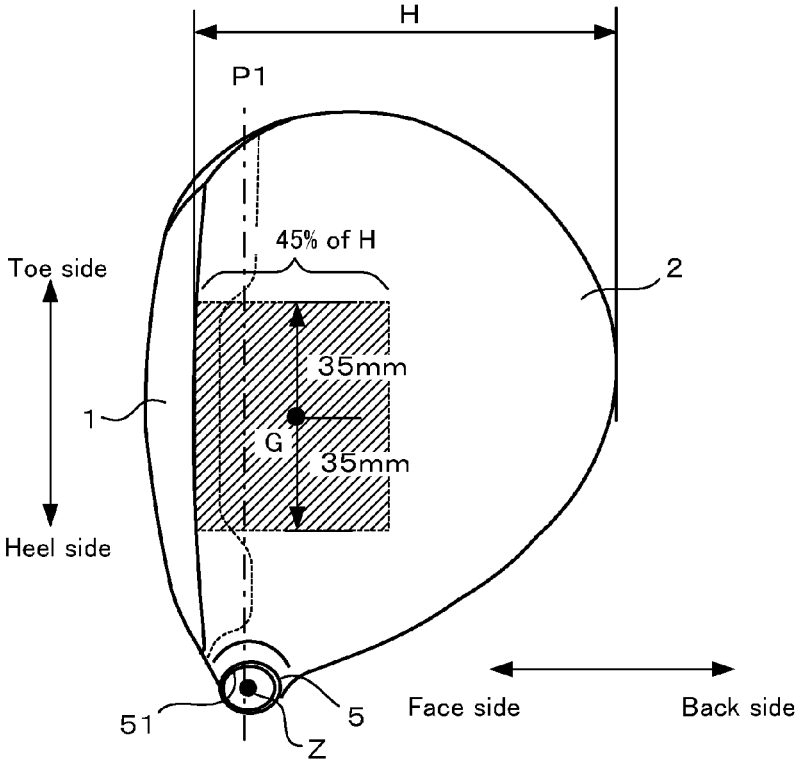
FIG. 2 is a plan view of FIG. 1.

A first embodiment of a golf club head according to the present invention is described below with reference to the drawings. FIG. 1 is a perspective view of a reference state of the golf club head according to the present embodiment, and FIG. 2 is a plan view of FIG. 1. Note that the reference state of the golf club head will be described later.

1. Overview of Golf Club Head

As shown in FIG. 1, the golf club head of the present embodiment (hereinafter, sometimes referred to as simply the "head") is a hollow structure and has wall surfaces formed by a face portion 1, a crown portion 2, a sole portion 3, a side portion 4, and a hosel portion 5.

The face portion 1 has a face surface that is the surface for hitting a ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the portion between the crown portion 2 and the sole portion 3, and extends from the toe side of the face portion 1, across the back side of the head, to the heel side of the face portion 1. Furthermore, the hosel portion 5 is the portion provided adjacent to the heel side of the crown portion 2, and has an insertion hole 51 for the insertion of the shaft (not shown) of the golf club. A central axis Z of the insertion hole 51 conforms to the axis of the shaft. The head described here is a wood-type head such as a fairway wood or a driver (#1), but there is no limitation on the type, and it may be of the so-called utility-type, hybrid-type, or the like. The same follows for a second embodiment described later.

The following describes the aforementioned reference state. First, as shown in FIGS. 1 and 2, the reference state is defined as a state in which the central axis Z is in a plane P1 that is perpendicular to the horizontal plane, and furthermore the head is placed on the horizontal plane at a predetermined lie angle and real loft angle. The plane P1 will be referred to as the reference vertical plane P1. Also, as shown in FIG. 2, the direction of the line of intersection of the reference vertical plane P1 and the horizontal plane will be referred to as the toe-heel direction, and the direction that is perpendicular to the toe-heel direction and parallel to the horizontal plane will be referred to as the face-back direction.

Figure 3:
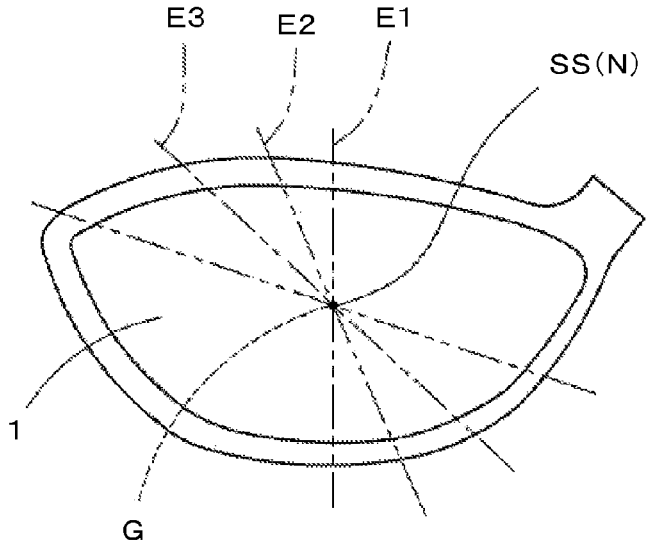
FIGS. 3A and 3B are diagrams for describing a boundary of a face portion.
Figure 3:
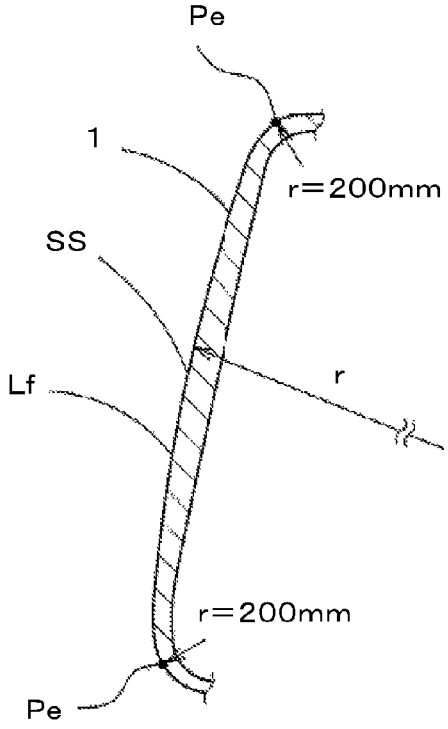

In the present embodiment, the boundary between the crown portion 2 and the side portion 4 can be defined as follows. Specifically, if a ridge line is formed between the crown portion 2 and the side portion 4, that ridge line serves as the boundary. In contrast, if a clear ridge line is not formed, the boundary is the outline that is seen when the head is placed in the reference state and viewed from directly above the center of gravity of the head. Similarly, in the case of the boundaries between the face portion 1 and the crown portion 2 and between the face portion 1 and the sole portion 3 as well, if a ridge line is formed, that ridge line serves as the boundary. However, if a clear ridge line is not formed, the peripheral edge (boundary) of the face portion 1 is defined by positions Pe where, in cross-sections E1, E2, E3, and so on that include a straight line N connecting the center of gravity G of the head and a sweet spot SS as shown in FIG. 3A, a radius of curvature r of an outline Lf of the outer surface of the face first reaches 200 mm when moving outward from the sweet spot side as shown in FIG. 3B. Note that the sweet spot SS is the intersection between the face surface and a normal line (straight line N) of the face surface that passes through the center of gravity G of the head.

Also, in the present embodiment, the boundaries between the sole portion 3 and the face portion 1 and between the sole portion 3 and the side portion 4 can be defined as follows. Specifically, if a ridge line is formed between the sole portion 3 and the face portion 1 or between the sole portion 3 and the side portion 4, that ridge line serves as the boundary. Also, although the golf club head of the present embodiment has the side portion 4, in cases where the side portion is omitted, the side portion 4 cannot be clearly distinguished and is included in the sole portion 3, or the sole portion 3 is directly connected to the crown portion 2, for example, then the ridge line between the sole portion 3 and the crown portion 2 serves as the boundary between them. Also, if a clear ridge line is not formed, the boundary is the outline that is seen when the head is placed in the reference state and viewed from directly above the center of gravity of the head. Also, the phrase "opening surrounded by the crown portion and the sole portion" in the present invention is synonymous with the phrase "opening surrounded by the crown portion, the sole portion, and the side portion" in the case where the head body is provided with a clear side portion. In other words, taking the case where the side portion cannot be clearly distinguished as described above into consideration as well, the "sole portion" of the present invention is deemed to also include the side portion.

The volume of this golf club head is, for example, preferably 300 $cm^3$ or more, more preferably 400 $cm^3$ or more, and particularly preferably 420 $cm^3$ or more. Having such a volume is advantageous for the head in terms of increasing comfort when the club is held and also increasing the sweet spot area and the moment of inertia. Note that although an upper limit is not particularly defined for the head volume, practically it is, for example, desirably 500 $cm^3$ or less, or desirably 470 $cm^3$ or less when complying with R&A or USGA rules and regulations.

Also, the head can be formed from, for example, a titanium alloy having a specific gravity of approximately 4.4 to 4.5 (e.g., Ti-6Al-4V). Besides a titanium alloy, the head can be formed from one or two or more materials selected from among stainless steel, maraging steel, an aluminum alloy, a magnesium alloy, an amorphous alloy, and the like. Also, there is no limitation to a metal material, and the head can also be formed using a fiber-reinforced plastic or the like. Such a golf club head can be produced using various methods, and it can be manufactured by casting using a known lost-wax precision casting method or the like. The above materials and manufacturing methods apply to the later-described second embodiment as well.

2. Assembly Structure of Golf Club Head

Figure 4:
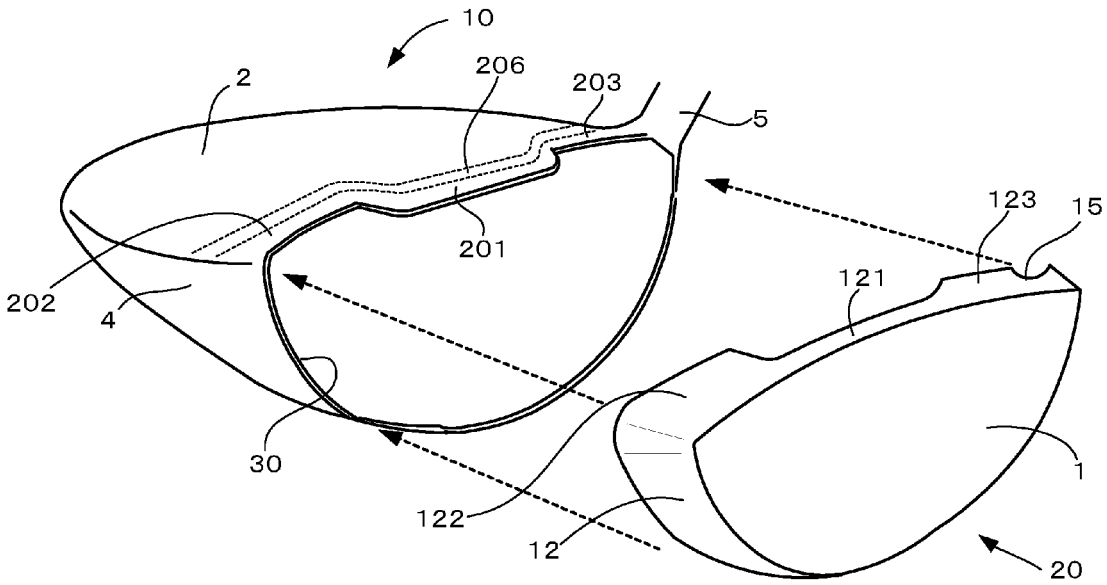
FIG. 4 is a perspective view of assembly of a head.

As shown in FIG. 4, the golf club head of the present embodiment is constituted by assembling a head body 10 and a face member 20. The head body 10 has the crown portion 2, the sole portion 3, and the side portion 4, and the face member 20 is shaped as a cup that has the face portion 1 and a peripheral portion 12 extending from the periphery of the face portion 1. This head body 10 has an opening 30 that is surrounded by the crown portion 2, the sole portion 3, and the side portion 4, and the face member 20 is attached so as to cover the opening 30. Specifically, the end surface of the peripheral portion 12 of the face member 20 is abutted against the end surface of the opening 30, and these two are joined by welding (TIG (Tungsten-Inactive Gas) welding, plasma welding, laser welding, brazing, etc.), for example. Thus, by attaching the face member 20 to the opening of the head body 10, it becomes integrated with the head body 10, and therefore the peripheral portion 12 of the face member 20 functions as a portion of the crown portion 2, the sole portion 3, and the side portion 4. Accordingly, the integral surface formed by attachment of the peripheral portion 12 of the face member 20 to the head body 10 constitutes the crown portion 2, the sole portion 3, and the side portion 4. For this reason, strictly speaking, the various portions of the head body 10 are portions of the integral surface, but the portions of the head body 10 are sometimes referred to as the crown portion 2, the sole portion 3, and the side portion 4 below instead of making this distinction.

3. Structure of Face Member

Figure 5:
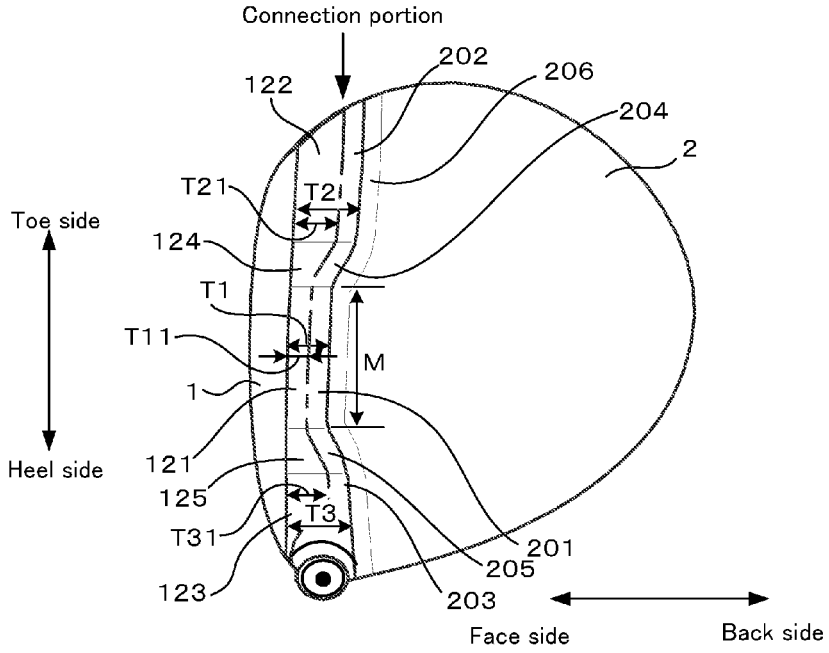
FIG. 5 is a plan view of FIG. 1.

Hereinafter, the face member will be described with reference to FIG. 5 as well. FIG. 5 is a plan view of the head in the reference state.

As described above, the face member 20 includes the plate-shaped face portion 1 and the peripheral portion 12. The peripheral portion 12 is formed with an approximately constant width (length of protrusion from the face portion 1), and the section joined to the crown portion 2 of the head body 10 is formed as follows. Specifically, as shown in FIGS. 4 and 5, a recessed portion is formed in the vicinity of the center in the toe-heel direction. More specifically, the peripheral portion 12 has a small width in the vicinity of the center in the toe-heel direction, and has a larger width on the two sides thereof, namely the toe side and the heel side. Hereinafter, the section of the peripheral portion 12 having a small width is referred to as a first central edge portion 121, the section having a larger width on the toe side is referred to as a first toe-side edge portion 122, and the section having a larger width on the heel side is referred to as a first heel-side edge portion 123. For example, it is preferable that a length M of the first central edge portion 121 in the toe-heel direction is 30 to 50 mm. It is preferable that a width T21 of the first toe-side edge portion 122 and a width T31 of the first heel-side edge portion 123 are 5 to 20 mm. Also, it is preferable that a width T11 of the first central edge portion 121 is 15 to 80% the widths T21 and T31 of the first toe-side edge portion 122 and the first heel-side edge portion 123, or more specifically 3 to 15 mm. Note that the heel-side end portion of the peripheral portion 12 is shaped so as to have a recessed portion 15 that does not interfere with the hosel portion 5.

Also, a first toe-side transition edge portion 124, in which the width changes gradually, is formed so as to span from the first toe-side edge portion 122 to the first central edge portion 121. Similarly, a first heel-side transition edge portion 125, in which the width changes gradually, is also formed so as to span from the first heel-side edge portion 123 to the first central edge portion 121. The thickness of the first central edge portion 121 is higher than the thicknesses of the first toe-side edge portion 122 and the first heel-side edge portion 123. For example, the thickness of the first central edge portion 121 can be set to 0.8 to 2.0 mm, and the thicknesses of the first toe-side edge portion 122 and the first heel-side edge portion 123 can be set to 0.4 to 1.2 mm. Also, the first toe-side transition edge portion 124 is formed such that the thickness progressively increases from the first toe-side edge portion 122 toward the first central edge portion 121. Similarly, the first heel-side transition edge portion 125 is formed such that the thickness progressively increases from the first heel-side edge portion 123 toward the first central edge portion 121.

Also, the face member 20 can be manufactured using a forging method, flat plate press machining, casting, or the like. The same follows for the second embodiment described later.

4. Structure of Crown Portion

Figure 6:
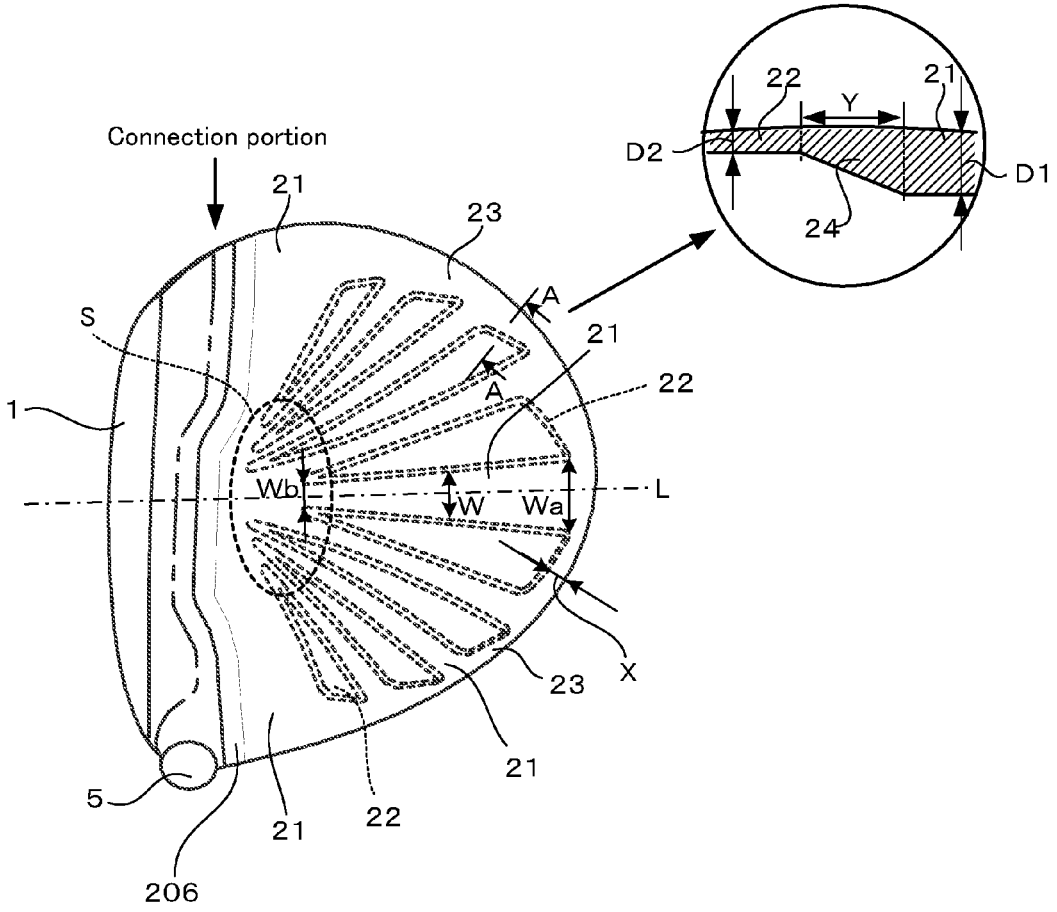
FIG. 6 includes a plan view of FIG. 1 and a cross-sectional view taken along line A-A.

Next, the crown portion 2 will be described with reference to FIG. 6 as well. FIG. 6 is a plan view of the golf club head, and the regions with different thicknesses in the crown portion 2 (later-described second regions) are particularly indicated by dashed lines. Also, the enlarged view in FIG. 6 is a cross-sectional view taken along line A-A.

First, the shape of the opening edge portion of the crown portion 2 will be described with reference to FIGS. 4 and 5. As described above, the first toe-side edge portion 122, the first central edge portion 121, and the first heel-side edge portion 123 are formed in the peripheral portion 12 of the face member 20, and the crown portion 2 of the head body 10 has a shape that corresponds to these three edge portions. Specifically, a second toe-side edge portion 202, a second central edge portion 201, and a second heel-side edge portion 203, which are to be joined to the first toe-side edge portion 122, the first central edge portion 121, and the first heel-side edge portion 123 respectively, are formed in the edge portion of the crown portion 2 on the opening side. These portions have approximately the same width in the face-back direction, and their thicknesses are the same as the opposing first toe-side edge portion 122, first central edge portion 121, and first heel-side edge portion 123. Also, a second toe-side transition edge portion 204 and a second heel-side transition edge portion 205 are formed in the edge portion of the crown portion 2 on the opening side so as to oppose the first toe-side transition edge portion 124 and the first heel-side transition edge portion 125 of the peripheral portion 12. The widths of these portions are also approximately the same, and their thicknesses are the same as the first toe-side transition edge portion 124 and the first heel-side transition edge portion 125. Furthermore, in the crown portion 2, a back-side transition portion 206 that extends in the toe-heel direction is formed on the back side of the second toe-side edge portion 202, the second central edge portion 201, and the second heel-side edge portion 203. The thickness of the back-side transition portion 206 progressively decreases as it extends toward the back side, and becomes the same as the thickness of a later-described first region 21 of the crown portion 2.

When the peripheral portion 12 of the face member 20 and the opening edge portion of the head body 10 are joined, the first and second toe-side edge portions 122 and 202, the first and second heel-side edge portions 123 and 203, the first and second central edge portions 121 and 201, the first and second toe-side transition edge portions 124 and 204, and the first and second heel-side transition edge portions 125 and 205 become integrated and contribute to restitution. Here, it is preferable that a total width T2 of the first and second toe-side edge portions 122 and 202 and a total width T3 of the first and second heel-side edge portions 123 and 203 are 10 to 30 mm. Also, it is preferable that a total width T1 of the first and second central edge portions 121 and 201 is 20 to 80% the total widths T2 and T3, which is specifically 5 to 24 mm for example.

Also, as shown in FIG. 6, in the crown portion 2, the region farther on the back side than the above-described back-side transition portion 206 is constituted by a first region 21 having a large thickness and multiple (eight in the present embodiment) second regions 22 having a small thickness. The second regions 22 each have a small thickness due to the formation of a recessed portion in the inner wall surface of the crown portion 2 as shown in FIG. 6. The second regions 22 are distributed so as to radiate toward the peripheral portion 23 of the crown portion 2 excluding the face side, from respective origins that are located in the vicinity of the face side in the face-back direction in a range of within 35 mm from the center of gravity G of the golf club head as the center in the toe-heel direction in a plan view. As shown in the enlarged view in FIG. 6, transitions portions 24 in which the thickness progressively increases are formed from the outer edges of the second regions 22 to the first region 21.

Note that an origin S of each of the second regions 22 is arranged in the hatched region shown in FIG. 2. Specifically, with respect to the toe-heel direction, this region extends 35 mm toward the toe side and 35 mm toward the heel side from the center of gravity G of the head as described above, and thus this region extends a total of 70 mm in the toe-heel direction. On the other hand, with respect to the face-back direction, the origins S of the second regions 22 are arranged in a range extending rearward from the boundary between the face portion 1 and the crown portion 2 to within 45% a length H of the crown portion 2 in the face-back direction, and the second regions 22 need only extend in a radiating manner from these origins S. The length H of the face-back direction is, as shown in FIG. 2, the distance H from the point located farthest on the face side on the boundary between the crown portion 2 and the face portion 1 to the point located farthest on the back side in the crown portion 2 in a plan view in the reference state. Furthermore, the phrase "in a radiating manner" need only be an aspect in which the second regions 22 extend from the origins S in the above-described hatched region toward the peripheral portion side of the crown portion 2 at predetermined angles, and it is sufficient that at least two or more second regions 22 are not aligned parallel to each other. Note that the phrase "the peripheral portion 23 of the crown portion 2 excluding the face side" refers to the portion of the peripheral portion of the crown portion 2 that excludes the portion in contact with the face portion 1. Also, the second regions 22 may extend from different origins S as described above, and an aspect is possible in which multiple second regions 22 extend in a radiating manner from one origin in the hatched region.

Providing the second regions 22 having a small thickness in the crown portion 2 as described above makes it possible for the amount of weight corresponding to the reduction in wall thickness compared to the first region 21 to be allocated to the side portion 4, for example. This makes it possible to increase the moment of inertia of the head.

The thicknesses of the regions 21 and 22 can be defined as follows. Specifically, in consideration of strength and rigidity, although there are differences depending on the material used, in the case where the head body is formed using a titanium alloy for example, a thickness D1 of the first region 21 can be set to 0.5 to 0.8 mm, and a thickness D2 of the second regions 22 can be set to 0.2 to 0.6 mm. Also, in the case where the head body is formed using stainless steel or maraging steel, the thickness D1 of the first region 21 can be set to 0.8 to 1.5 mm, and the thickness D2 of the second regions 22 can be set to 0.5 to 1.3 mm. Also, a width Y of the transition portions 24 is, for example, preferably 0.5 to 10 mm or more preferably 2.0 to 6.0 mm.

In the plan view of the head shown in FIG. 6, it is preferable that a ratio R of a projected area S1 of all of the second regions 22 occupying an area S2, which is the total of the projected area of the crown portion and the projected area of the hosel portion, (ratio R=S1/S2) is 20 to 50%. If this ratio R is smaller than 20%, the effect of improving the moment of inertia is not likely to be obtained. For this reason, the ratio R is more preferably 23% or more, and particularly preferably 25% or more. On the other hand, if the ratio R is larger than 50%, casting performance decreases. For this reason, the ratio R is more preferably 45% or less, and particularly preferably 40% or less. For example, in the case of a driver, the area S2 is approximately 80 to 120 $cm^2$.

Also, as shown in FIG. 6, the second regions 22 are each formed so as to increase in width from the origin S side toward the peripheral portion 23 side, and approximately have a fan shape, for example, in the present embodiment. Similarly, the portions of the first region 21 arranged between adjacent second regions 22 are also constituted such that a width W increases from the origin S side toward the peripheral portion 23 side, and approximately have a fan shape. In the portions of the first region 21 arranged between adjacent second regions 22 in this way, a width Wa of the end portion on the peripheral portion 23 side can be set to 5 to 20 mm. Also, it is preferable that a width Wb of the end portion of the first region 21 on the origin S side is 1 to 8 mm. In particular, if the width Wa of the end portion on the peripheral portion 23 side is smaller than 5 mm, there is a risk of a decrease in the effect of increasing the moment of inertia, and there is a risk of poor flow of molten metal in later-described casting. On the other hand, if the width Wa of the end portion on the peripheral portion 23 side is larger than 20 mm, weight reduction of the crown portion 2 is impaired, and there is a risk of limiting the effect of increasing the moment of inertia due to not being able to ensure weight for allocation from the crown portion 2 to the side portion 4, for example. Note that the moment of inertia referred to here is the moment of inertia about a perpendicular axis that passes through the center of gravity of the head (horizontal moment of inertia).

Furthermore, the portion of the first region 21 between the face portion 1 and the second region 22 arranged the farthest on the toe side is formed so as to spread out. Specifically, this portion of the first region 21 is formed in a fan shape in which the length in the face-back direction increases as the portion extends toward the toe side. Similarly, the portion of the first region 21 between the face portion 1 and the second region 22 arranged the farthest on the heel side is formed so as to spread out. Specifically, this portion of the first region 21 is formed in a fan shape in which the length in the face-back direction increases as the portion extends toward the heel side.

Also, the peripheral portion 23 of the crown portion 2 is constituted by the first region 21. Accordingly, the end edge of each of the second regions 22 on the peripheral portion 23 side is not directly in contact with the side portion 4, but rather is separated from the side portion 4 by a portion of the first region 21 having a large thickness. A width X of this portion of the first region 21 can be set to 1 to 30 mm, for example. If this width X is smaller than 1 mm, there is a risk of a decrease in the effect of increasing the moment of inertia. On the other hand, if the width X is larger than 30 mm, there is a risk of impairing weight reduction of the crown portion 2.

5. Golf Club Head Manufacturing Method

Next, an example of a method for manufacturing the golf club head configured as described above will be described. The head body of the golf club head according to the present embodiment is manufactured by casting using a known lost wax precision casting method, for example. The opening of the completed head body 10 is then abutted against the peripheral portion 12 of the face member 20, and the abutting portions are joined by welding. Thereafter, coatings and the like are applied, and the golf club head is completed.

6. Features

The golf club head of the present embodiment configured as described above can obtain effects such as the following.

(1) In the peripheral portion 12 of the cup face structure, the portion opposing the crown portion 2 of the head body 10 is provided with the first central edge portion 121 located in the vicinity of the center in the toe-heel direction and having a small width, and the first toe-side edge portion 122 and the first heel-side edge portion 123 located on the two sides thereof and having a large width. In other words, a recessed portion is formed in the vicinity of the center of the peripheral portion 12. A protruding portion is correspondingly formed in the vicinity of the center of the crown portion 2, and fits into the recessed portion of the peripheral portion in the opening of the head body 10. Also, in the peripheral portion 12, the first toe-side edge portion 122 and the first heel-side edge portion 123 have smaller thicknesses than the first central edge portion 121. For this reason, it is possible to improve the restitution performance on the heel side and the toe side. Furthermore, on the crown portion 2 side as well, the second toe-side edge portion 202 and the second heel-side edge portion 203 have smaller thicknesses than the second central edge portion 201. In other words, in the region extending from the peripheral portion 12 to the edge portion of the crown portion 2 on the face side, the area of the portion having a small thickness is large on the toe side and the heel side. For this reason, it is possible to further improve the restitution performance on the heel side and the toe side.

(2) In the crown portion 2, portions of the first region 21 having a large thickness are arranged between adjacent thin second regions 22, thus making it possible to suppress a reduction in mechanical strength caused by thickness reduction. Also, adjusting the number and positions of the second regions 22 makes it possible to arrange a portion of the first region 21 having a large thickness in the central portion of the crown portion 2 where the impact is high, and this has an additional advantage of making it possible to ensure the strength of the head. Furthermore, the first region 21 is distributed so as to radiate from the face side as the origin toward the back side, and this also makes it possible to suppress a reduction in mechanical strength.

(3) Portions of the first region 21 arranged between adjacent second regions 22 are constituted so as to increase in width from the origin S side toward the peripheral portion 23 side, thus making it possible for the allocation of weight in the reduced-weight crown portion 2 to increase toward the peripheral portion 23 side. Accordingly, it is possible to increase the moment of inertia about a perpendicular axis that passes through the center of gravity of the head, thus making it possible to improve the ability to control the direction of a hit ball.

(4) Providing multiple second regions 22 having a small thickness in the crown portion 2 makes it possible to reduce the weight of the crown portion 2. The amount of weight corresponding to the reduced wall thickness for weight reduction can then be allocated to other portions of the head as described above. This makes it possible to improve the degree of freedom in designing the head. For example, if the aforementioned weight is allocated to the sole portion 3 of the club head, it is possible to lower the center of gravity, which results in the ability to raise the hitting angle. Alternatively, if the weight is allocated to the side portion 4, it is possible to increase the moment of inertia about the perpendicular axis that passes through the center of gravity of the head, thus making it possible to improve the ability to control the direction of a hit ball.

(5) The portion of the first region 21 between the face portion 1 and the second region 22 arranged farthest on the heel side is formed so as to spread out in a fan shape. The heel side of the crown portion 2 generally tends to undergo deformation, and therefore there is a risk of the ball hitting pitch being lowered due to vibration occurring in the heel side portion. However, if the thick first region 21 is formed so as to spread out on the heel side, rigidity increases, and it possible to prevent a negative influence on the ball hitting sound.

(6) When the head body including the above-described crown portion is manufactured by casting, the peripheral portion 23 of the crown portion 2 includes the first region 21 having a large thickness, and therefore molten metal is easily poured in through this portion. The molten metal poured into the peripheral portion 23 then flows toward the origin S side into the thick first region 21 while flowing around the crown portion 2. The pressure acting in the molten metal flowing into the first region 21 increases as it flows toward the face side, and therefore the molten metal flows into adjacent second regions 22 in order to release the pressure. Accordingly, it is possible to cause the molten metal to sufficiently spread into the thin second regions 22 as well, thus making it possible to prevent molding defects.

7. Variations

Although the first embodiment of the present invention has been described above, the present invention is not limited to the first embodiment, and various modifications can be made without departing from the gist of the invention. The following are examples of modifications that can be made.

7-1

In the first embodiment, the transition edge portions 124, 125, 204, and 205 are provided, but these transition edge portions do not need to be provided. Also, it is sufficient that at least a portion of the first and second central edge portions 121 and 201 has a larger thickness than the first and second toe-side edge portions 122 and 202 and the first and second heel-side edge portions 123 and 203, and therefore a configuration is possible in which, for example, the thickness progressively decreases from any position in the first and second central edge portions 121 and 201 to any position in the first and second toe-side edge portions 122 and 202 or the first and second heel-side edge portions 123 and 203.

7-2

In the first embodiment, the first toe-side edge portion 122, the first central edge portion 121, and the first heel-side edge portion 123 are provided in the peripheral portion 12 of the face member 20, and furthermore the second toe-side edge portion 202, the second central edge portion 201, and the second heel-side edge portion 203 having different thicknesses are provided on the crown portion 2 side of the head body 10 for joining to the aforementioned portions, but such edge portions do not need to be provided in the crown portion 2. Specifically, a configuration is possible in which merely a protruding portion is provided in the edge portion of the crown portion 2 on the opening side for joining to the first toe-side edge portion 122, the first central edge portion 121, and the first heel-side edge portion 123, and the thickness is the same along the opening. In this way, even if the thickness of the crown portion 2 on the opening side is constant, by merely varying the thickness of the peripheral portion 12 of the face member 20 as described above, it is possible to improve the restitution performance on the toe side and the heel side.

7-3

In the first embodiment, the thickness is set the same for the peripheral portion 12 of the face member 20 and the edge portion of the crown portion 2 on the opening side that is joined thereto, but these thicknesses may be different.

7-4

Also, although the configuration of the face member 20 (particularly the structure of the peripheral portion 12) is described in the first embodiment, there are no particular limitations on the structure of the face portion 1. For example, although the thickness in the center of the face portion 1 is increased to raise the mechanical strength with respect to impact, there are no particular limitations on this thickness, including the thickness in other regions.

7-5

Figure 7:
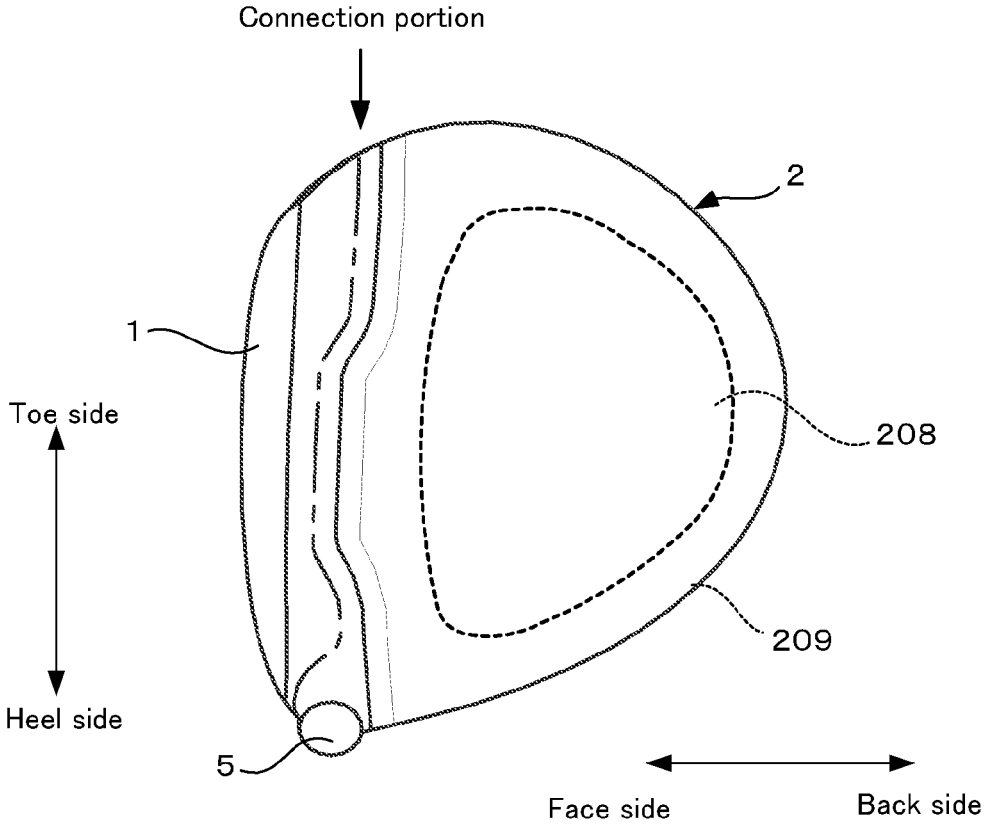
FIG. 7 is a plan view of another example of a golf club head according to the present invention.

Also, there are no particular limitations on the configuration of portions other than the face portion 1 either. Specifically, the crown portion 2, the sole portion 3, and the side portion 4 may have any configuration as long as it is possible to attach the face member 20. For example, although the thickness is varied in the crown portion 2 in the above embodiment, this is merely one example, and the manner in which the thickness is varied can be modified as necessary. For example, if a thin region 208 (inner region) is provided in the center of the crown portion 2, and a thick region 209 (peripheral edge region) is provided so as to surround the thin region 208 as shown in FIG. 7, it is possible to increase the moment of inertia about the perpendicular axis that passes through the center of gravity of the head, thus making it possible to improve the ability to control the direction of a hit ball.

Working Example

The following describes a working example of the present invention. Note that the present invention is not limited to the following working example.

(1) Preparation of Working Example and Comparative Example

Golf club heads (#1 driver) according to a working example and a comparative example having different face member structures were produced as shown in Table 1. The working example was the golf club head shown in FIGS. 1 to 6 according to the first embodiment. On the other hand, the comparative example differed from the working example in that the toe-side edge portion, the central edge portion, and the heel-side edge portion of the face member all had the same thickness, but other aspects of the configuration were the same. Regarding the other aspects of the configuration, the heads according to the working example and the comparative example had a two-piece structure in which a head body constituted by a Ti-6Al-4V lost wax precision molded part was laser welded to a cup-shaped face member constituted by a TIX-51AF hot forged part manufactured by Nippon Steel & Sumitomo Metal Corporation. Also, the head volume was 460 $cm^3$, and the head mass was 196 g. The width of the face portion in the toe-heel direction was 104 mm, and the height in the up-down direction was 48 mm.

TABLE 1

| | Working Example | Comparative Example |
|---|---|---|
| Length M of central edge portion | 40 mm | |
| Width T2 of 1st & 2nd toe-side edge portions | 10 mm | |

TABLE 1-continued

| | Working Example | Comparative Example |
|---|---|---|
| Width T1 of 1st & 2nd central edge portions | 5 mm | |
| Width T3 of 1st & 2nd heel-side edge portions | 10 mm | |
| Thickness of 1st & 2nd toe-side edge portions | 0.90 mm | 1.20 mm |
| Thickness of 1st & 2nd central edge portions | 1.20 mm | |
| Thickness of 1st & 2nd heel-side edge portions | 0.90 mm | |
| Thickness D1 of first region of crown portion | 0.60 mm | |
| Thickness D2 of second region of crown portion | 0.45 mm | |

Figure 8:
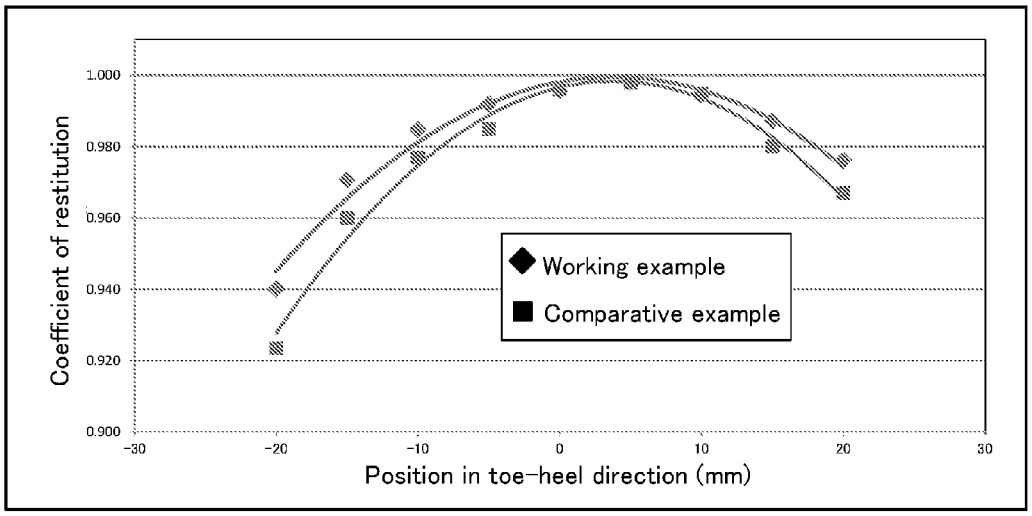
FIG. 8 is a graph showing coefficients of restitution measured in a working example and a comparative example.

Restitution performance tests were performed on the working example and the comparative example. Specifically, a coefficient of restitution was obtained for the working example and the comparative example in accordance with "Procedure for Measuring the Velocity Ratio of a Club Head for Conformance to Rule 4-1e", Revision 2 (Feb. 8, 1999) by the USGA (United States Golf Association). Measurement was performed on the face portion of the head in the reference position, along a straight line extending in the toe-heel direction and passing through the face center (centroid of the face). Note that the position in the toe-heel direction takes a positive value on the heel side and a negative value on the toe side, with the face center serving as the origin. The results are shown in FIG. 8, and it should be noted that the coefficients of restitution are indicated by relative values. As shown in this figure, out of the working example and the comparative example, the relative value of the coefficient of restitution of the working example was higher on the toe side and the heel side. This is thought to be because in the peripheral portion of the face portion and the vicinity of the opening of the crown portion, the thicknesses of the first and second toe-side edge portions and the first and second heel-side edge portions were smaller than the thicknesses of the first and second central edge portions.

B. Second Embodiment

A golf club head according to a second embodiment of the present invention is described below with reference to the drawings.

1. Overview of Golf Club Head

Figure 9:
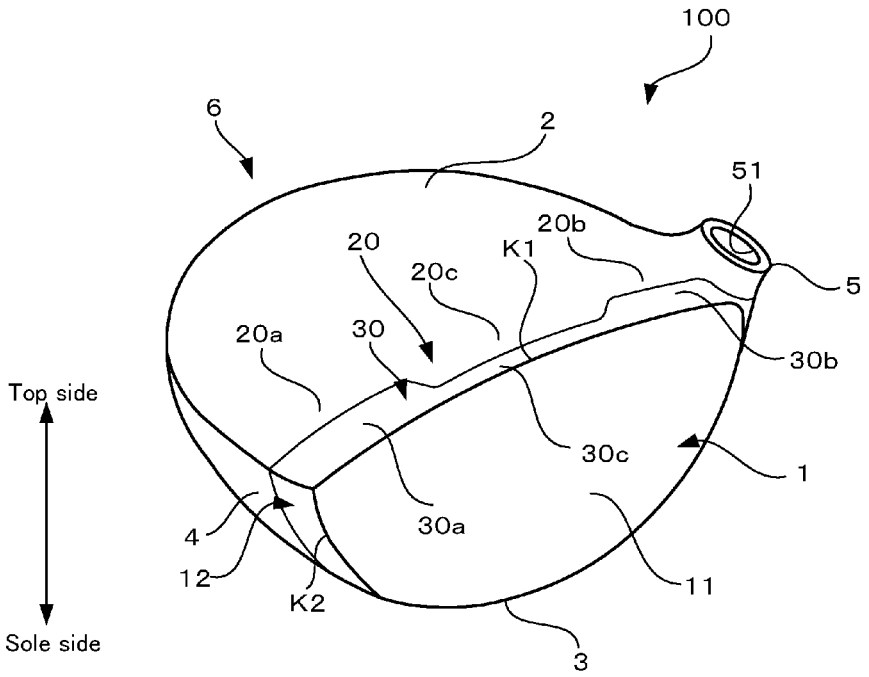
FIG. 9 is a perspective view of a golf club head according to a second embodiment of the present invention in a reference state.
Figure 10:
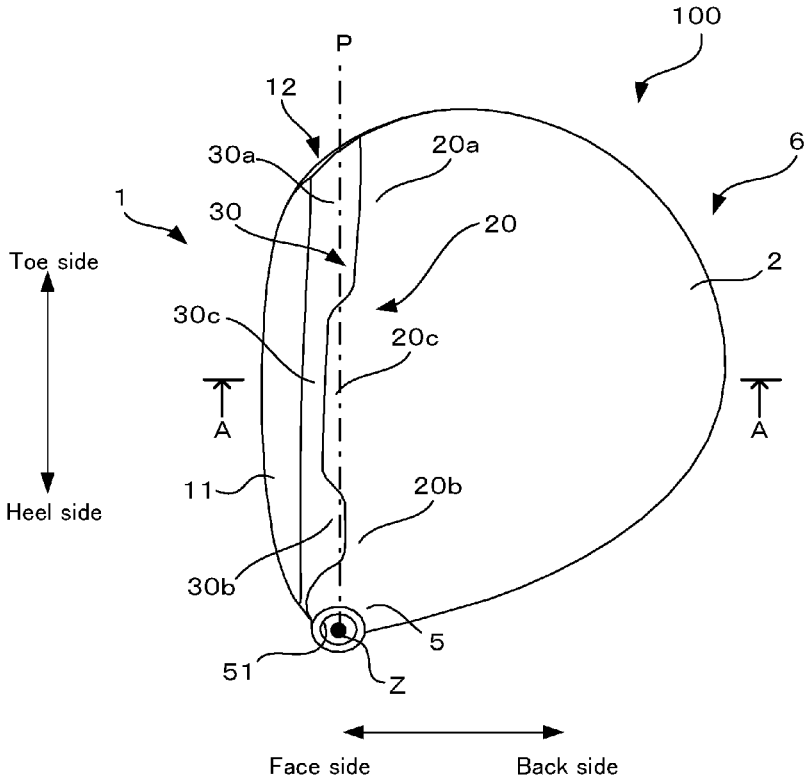
FIG. 10 is a plan view of the golf club head in the reference state.

FIG. 9 is a perspective view of a golf club head (hereinafter sometimes simply referred to as the "head") 100 of the present embodiment in a reference state, and FIG. 10 is a plan view of the head 100 in the reference state. Note that the reference state of the golf club head will be described later. The head 100 is a hollow structure and has wall surfaces formed by a face member 1, a crown portion 2, a sole portion 3, a side portion 4, and a hosel portion 5.

The face member 1 constitutes a front portion of the head 100 that serves as the surface for hitting a ball. The crown portion 2 is adjacent to the face member 1 and constitutes the upper surface of the head 100. The sole portion 3 constitutes the bottom surface of the head 100, and is adjacent to the face member 1 and the side portion 4. Also, the side portion 4 is the portion between the crown portion 2 and the sole portion 3, and extends from the toe side of the face member 1, across the back side of the head 100, to the heel side of the face member 1. Furthermore, the hosel portion 5 is the portion provided adjacent to the heel side of the crown portion 2, and has an insertion hole 51 for the insertion of the shaft (not shown) of the golf club. A central axis Z of the insertion hole 51 conforms to the axis of the shaft.

The following describes the aforementioned reference state. As shown in FIGS. 9 and 10, the reference state is defined as a state in which the central axis Z is in a plane P (hereinafter, the reference vertical plane P) that is perpendicular to a horizontal plane H (see FIG. 11), and furthermore the head is placed on the horizontal plane H at a predetermined lie angle and real loft angle. Also, as shown in FIG. 10, the direction of the line of intersection of the reference vertical plane P and the horizontal plane H will be referred to as the toe-heel direction, and the direction that is perpendicular to the toe-heel direction and parallel to the horizontal plane H will be referred to as the face-back direction. Also, the direction perpendicular to the horizontal plane H will be referred to as the top-sole direction. Note that in the description of the present embodiment, unless otherwise stated, "forward-rear" means the face-back direction, the "face side" is forward, and the "back side" is rearward. Also, unless otherwise stated, "up-down" refers to the top-sole direction, the "top side" is upward, and the "sole side" is downward.

The head 100 of the present embodiment is constituted by assembling the face member 1 with a head body 6 that is a hollow structure having the crown portion 2, the sole portion 3, the side portion 4, and the hosel portion 5. The head body 6 and the face member 1 are joined by welding, similarly to the first embodiment. The head body 6 has an opening on the front side surrounded by the crown portion 2, the sole portion 3, and the side portion 4, and the face member 1 is attached so as to cover this opening. The head body 6 can also be an assembly of multiple parts, and can also be formed as a single body.

Figure 11:
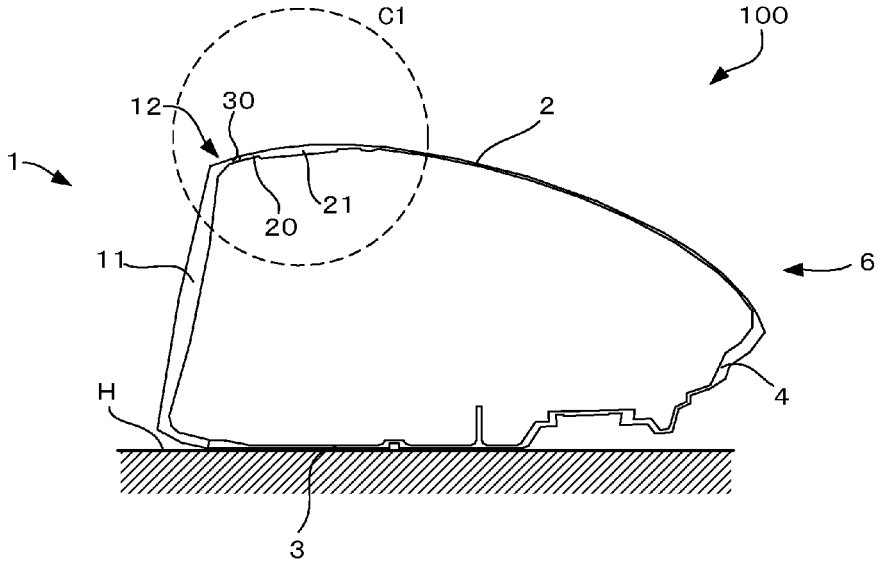
FIG. 11 is a cross-sectional view taken along line A-A in FIG. 10.

Hereinafter, the face member 1 will be described with reference to FIG. 11 as well. FIG. 11 is a cross-sectional view taken along line A-A in FIG. 10. As shown in FIGS. 9 to 11, the face member 1 of the present embodiment is of the so-called "cup face" type. In other words, the face member 1 is shaped as a cup that has a flat plate-shaped face portion 11 for hitting a ball and a rising portion (extending portion) 12 that extends rearward from the peripheral edge of the face portion 11.

This cup face-type face member 1 has a higher restitution factor in the face portion 11 than a face member not having a rising portion, because the area of flexure is larger by an amount corresponding to the rising portion 12. Also, in the case where the cup face structure is employed, the connection portion of the face member 1 and the head body 6, where rigidity tends to increase, moves rearward of the face portion 11, and therefore the overall face portion 11 flexes easily. Accordingly, the cup face structure contributes to an increase in flight-distance.

Additionally, various innovations have been made to the golf club head 100 in order to improve the restitution factor of the face portion 11 for the purpose of increasing the flight-distance. Specifically, a characteristic structure has been formed in the vicinity of the connection portion of the face member 1 and the head body 6, and an innovation has also been made to the thickness structure of the crown portion 2 and the face portion 11. These features will be described below in order.

2. Structure in Vicinity of Connection Portion of Face Member and Head Body

As shown in FIGS. 9 and 10, a front edge portion 20 of the crown portion 2 has a protruding shape in which a central region thereof projects forward. Specifically, the front edge portion 20 of the crown portion 2 has a first toe-side portion 20*a* that is on the toe side, a first heel-side portion 20*b* that is on the heel side, and a first central portion 20*c* located between the portions 20*a* and 20*b*, and the first central portion 20*c* projects forward more than the first toe-side portion 20*a* and the first heel-side portion 20*b*. On the other hand, in the rising portion 12 of the face member 1, the portion fixed to the front edge portion 20 of the crown portion 2 (hereinafter, the fixed portion being referred to as the "upper rising portion 30) has a structure that corresponds to the above-described structure of the crown portion 2. Specifically, the upper rising portion 30 has a protruding shape in which the two side regions project rearward. Specifically, the upper rising portion 30 has a second toe-side portion 30*a* that is joined to the first toe-side portion 20*a*, a second heel-side portion 30*b* that is joined to the first heel-side portion 20*b*, and a second central portion 30*c* that is joined to the first central portion 20*c*. Also, the second toe-side portion 30*a* and the second heel-side portion 30*b* project rearward more than the second central portion 30*c*. Note that the second central portion 30*c* is the portion located between the second toe-side portion 30*a* and the second heel-side portion 30*b*.

The protruding shape of the front edge portion 20 of the crown portion 2 and the protruding shape of the upper rising portion 30 of the face member 1 contribute to an enlargement of the high restitution area on the face portion 11. Specifically, the connection portion of the face member 1 and the head body 6 moves closer to a position toward the face portion 11 in the vicinity of the center in the toe-heel direction, and therefore the restitution factor in the central region of the face portion 11 decreases. As a result, relatively, the amount of flexure during ball-hitting increases in the toe-side and heel-side portions of the face portion 11, and thus the restitution factor improves in the face portion 11 overall.

Figure 12:
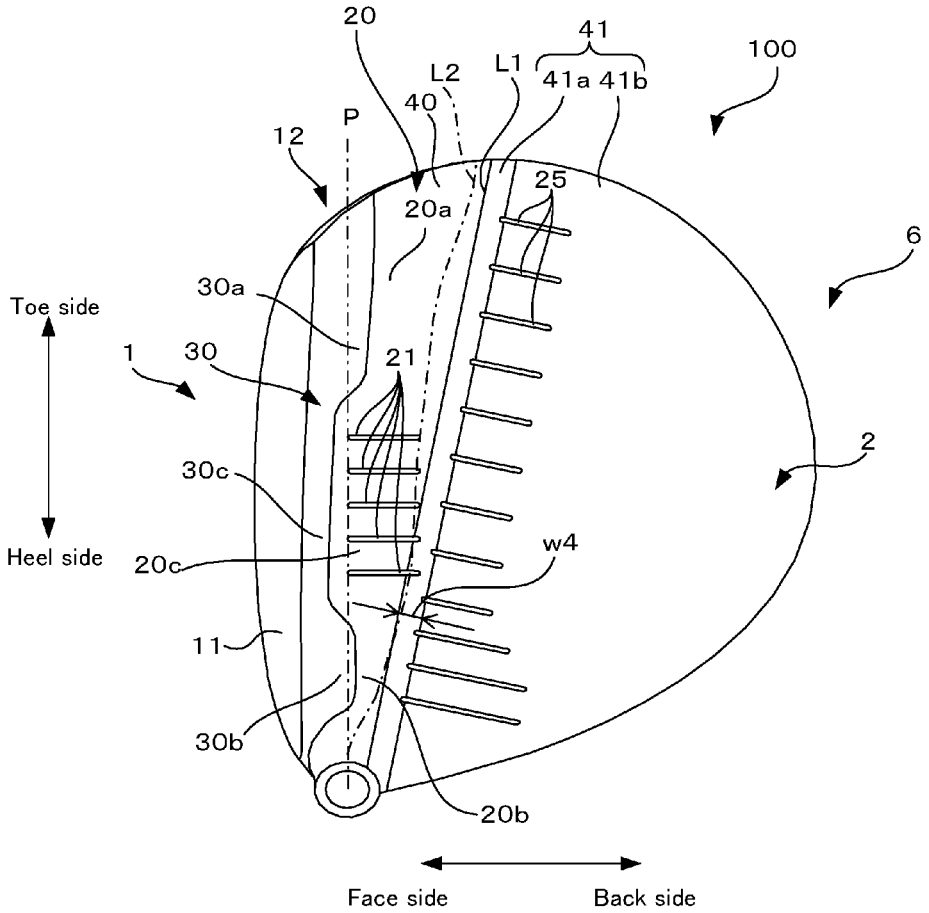
FIG. 12 is a plan view of the golf club head in the reference state, showing the structure of the inner surface of a crown portion.

In order to enhance the above effect of enlarging the high restitution area, the first central portion 20*c* is constituted so as to have a higher rigidity than the first toe-side portion 20*a* and the first heel-side portion 20*b*. Specifically, as shown in FIGS. 11 and 12, multiple ribs 21 are formed on the inner surface of the first central portion 20*c*. Note that FIG. 12 is a plan view of the head 100 in the reference state. Accordingly, it would not be possible to see the ribs 21 formed on the inner surface of the crown portion 2 in this figure. However, in consideration of facilitating understanding, the positions of the ribs 21 are shown in the figure. The same also follows for ribs 25, a thickness transition portion 41*a*, raised portions 28, and the like that will be described later. Note that in the present embodiment, protrusions and recessions caused by these portions 21, 25, 41*a*, and 28 do not appear on the outer surface of the crown portion 2. In other words, the outer surface of the crown portion 2 has a smooth configuration.

In the present embodiment, the ribs 21 extend as long, thin, straight lines in the face-back direction. Accordingly, it is possible to effectively increase the rigidity of the first central portion 20*c* and suppress the restitution factor in the central region of the face portion 11. Note that in the description of the present embodiment, the phrase "extend in the face-back direction" includes not only the case of extending parallel with the face-back direction defined above, but also the case of extending in a direction that intersects the face-back direction. An angle $\theta 1$ formed by the face-back direction and the extending direction of the ribs 21 satisfies the relationship $0° \leq \theta 1 < 180°$, more preferably satisfies the relationship $\theta 1 \leq 70°$ or $\theta 1 \geq 110°$, and even more preferably satisfies the relationship $\theta 1 \leq 45°$ or $\theta 1 \geq 135°$.

Figure 13:
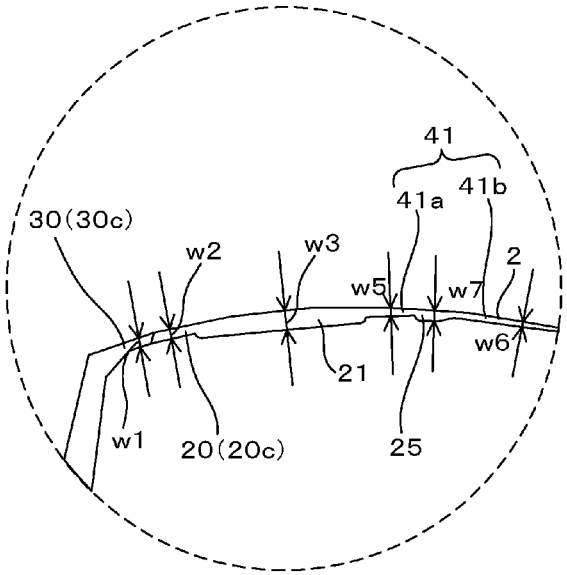
FIG. 13 is an enlarged view of a region in a circle C1 indicated by a dashed line in FIG. 11.

FIG. 13 is an enlarged view of a region in a circle C1 indicated by a dashed line in FIG. 11. In the present embodiment, the upper rising portion 30 overall has a roughly uniform thickness w1. Accordingly, the thicknesses of the second toe-side portion 30*a*, the second heel-side portion 30*b*, and the second central portion 30*c* are approximately the same. Similarly, the front edge portion 20 of the crown portion 2 overall also has a roughly uniform thickness w2. Accordingly, the thicknesses of the first toe-side portion 20*a*, the first heel-side portion 20*b*, and the first central portion 20*c* are approximately the same. The thicknesses w1 and w2 can be set as required, but w1 preferably satisfies the relationship 0.4 mm≤w1≤3.5 mm, more preferably satisfies the relationship 0.6 mm≤w1≤2.0 mm, and even more preferably satisfies the relationship 0.8 mm≤w1≤1.5 mm. Also, w2 preferably satisfies the relationship 0.4 mm≤w2≤3.5 mm, more preferably satisfies the relationship 0.6 mm≤w2≤2.0 mm, and even more preferably satisfies the relationship 0.8 mm≤w2≤1.5 mm.

The relationship between the thickness w1 of the upper rising portion 30 and the thickness w2 of the front edge portion 20 of the crown portion 2 is preferably w1>w2−1 mm, and is more preferably w1>w2−0.5 mm. In this way, if w1 is greater than w2, or there is almost no difference between the two thicknesses w1 and w2, the region of the connection portion of the rising portion 12 and the crown portion 2 becomes the origin of bending during ball-hitting, and can flex a large amount. As a result, it is possible to improve the restitution factor of the face portion 11 overall during ball-hitting. Also, with the above configuration, the upper rising portion 30 region in particular flexes easily along the rear end of the rising portion 12, thus making it possible to raise the ball hitting angle.

Also, although the height of the ribs 21 can be set as required, a thickness w3 (w3>w2) of the portion formed by the ribs 21 preferably satisfies the relationship 0.6 mm≤w3≤5.0 mm, more preferably satisfies the relationship 0.8 mm≤w3≤3.0 mm, and even more preferably satisfies the relationship 1.0 mm≤w3≤2.0 mm.

According to the structure described above, in the present embodiment, it is possible to suppress the restitution factor in the central region, where the restitution factor tends to increase, in the face portion 11. As a result, it is possible to increase the restitution factor in the heel-side and toe-side portions of the face portion 11, while also adhering to golf competition rules related to the restitution factor. Accordingly, it is possible to enlarge the high restitution area in the face portion 11. As a result, it is possible to increase the flight-distance even if the ball is not grabbed at the central region of the face portion 11 in a mishit or an intentional shot, for example.

3. Thickness Structure of Crown Portion

Next, the thickness structure of the crown portion 2 that contributes to an increase in the flight-distance will be described. Specifically, in the crown portion 2, the rearward region has a lower thickness than the front edge portion 20. In other words, in the crown portion 2, the region forward of a boundary line L1 shown in FIG. 12 is formed as a thick region 40. On the other hand, the region rearward of the boundary line L1 is formed as a thin region 41 that is thinner than the thick region 40. Note that in the present embodiment, the thick region 40 and the front edge portion 20 are equivalent to each other.

The boundary line L1 extends in the toe-heel direction from the vicinity of the heel-side end portion of the crown portion 2 to the vicinity of the toe-side end portion. Note that in the description of the present embodiment, the phrase "extends in the toe-heel direction" is a concept that includes not only the case of extending parallel with the toe-heel direction defined above, but also the case of extending in a direction that intersects the toe-heel direction.

In the present embodiment, the thin region 41 decreases in thickness in a stepwise manner as it extends rearward. Specifically, the thin region 41 includes a thickness transition portion 41*a* that extends from the vicinity of the heel-side end portion of the crown portion 2 to the vicinity of the toe-side end portion, and a thin portion 41*b* that spreads out rearward of the thickness transition portion 41*a*. The front edge of the thickness transition portion 41*a* is defined by the boundary line L1. The thickness transition portion 41*a* is thinner than the thick region 40, and the thin portion 41*b* is thinner than the thickness transition portion 41*a*. The thickness transition portion 41*a* of the present embodiment is a long and thin region that extends in the toe-heel direction, and a width w4 (see FIG. 12) thereof is roughly constant along the toe-heel direction. The width w4 preferably satisfies the relationship 0.5 mm≤w4≤10 mm, more preferably satisfies the relationship 1.0 mm≤w4≤8.0 mm, and even more preferably satisfies the relationship 2.0 mm≤w4≤5.0 mm.

The thickness transition portion 41*a* of the present embodiment has a roughly uniform thickness w5 overall, and the thin portion 41*b* also has a roughly uniform thickness w6 overall (see FIG. 13). In other words, the thickness of the crown portion 2 changes in a stepwise manner from the thick region 40 toward the thin portion 41*b*. The thicknesses w5 and w6 can be set as required, but w5 preferably satisfies the relationship 0.3 mm≤w5≤3.5 mm, more preferably satisfies the relationship 0.4 mm≤w5≤2.0 mm, and even more preferably satisfies the relationship 0.4 m≤w5≤1.5 mm. Also, w6 preferably satisfies the relationship 0.3 mm≤w6≤3.5 mm, more preferably satisfies the relationship 0.4 mm≤w6≤2.0 mm, and even more preferably satisfies the relationship 0.4 mm≤w6≤1.5 mm. Note that a configuration is possible in which the thickness w5 of the thickness transition portion 41*a* gradually decreases in a continuous manner from the thick region 40 toward the thin portion 41*b*.

The upper rising portion 30 and the front edge portion 20 of the crown portion 2 are in the vicinity of the face portion 11, and therefore are easily influenced by a hit. For this reason, it is preferable that the thicknesses w1 and w2 are set relatively high in order to ensure strength. However, if these portions in the vicinity of the face portion 11 are thick, the restitution factor of the face portion 11 tends to decrease. On the other hand, the same level of strength as the front edge portion 20 is not required for the rear portion of the crown portion 2. In view of this, in the present embodiment, the thin region 41 is formed in the rear portion of the crown portion 2, and flexure in the same area is caused to propagate to the face portion 11, thus preventing a reduction in the restitution factor of the face portion 11.

As shown in FIGS. 12 and 13, in the thin region 41, multiple ribs 25 (protruding portions) that are aligned along the boundary line L1 are formed on the inner surface of the front edge portion of the thin portion 41*b*. Specifically, the ribs 25 are formed at positions that are in the vicinity of the boundary line L1 and rearward of the boundary line L1 via somewhat of a gap. Note that as shown in FIG. 12, the ribs 25 of the present embodiment are not only formed on the front edge portion of the thin portion 41*b*, but also extend to the thickness transition portion 41*a*.

Although the height of the ribs 25 can be set as required, a thickness w7 (w7>w5,w6) of the portions formed by the ribs 25 preferably satisfies the relationship 0.4 mm≤w7≤7.0 mm, more preferably satisfies the relationship 0.6 mm≤w7≤4.0 mm, and even more preferably satisfies the relationship 0.8 mm≤w7≤2.0 mm.

When a ball is hit by the face portion 11, the impact of the hit propagates from the face side to the back side. The ribs 25 configured as described above can effectively increase the rigidity somewhat rearward of the boundary line L1 between the thick region 40 and the thin region 41. As a result, the thickness transition portion 41*a* is a region whose thickness changes a large amount in the face-back direction, and the rigidity rearward thereof is increased by the ribs 25, and thus the crown portion 2 bends a large amount in the thickness transition portion 41*a* during ball hitting. Specifically, during ball hitting, flexure occurs in the vicinity of the connection portion of the rising portion 12 and the crown portion 2 connection portion, and a large amount of flexure also occurs in the vicinity of the boundary line L1, that is to say in the vicinity of the thickness transition portion 41*a*. In this way, flexure occurs at two places in the crown portion 2, thus effectively improving the restitution factor of the face portion 11 overall.

The ribs 25 of the present embodiment extend as long, thin, straight lines in the face-back direction in order to increase the above-described effect of improving the rigidity. An angle θ2 formed by the face-back direction and the extending direction of the ribs 25 satisfies the relationship 0°≤θ2<180°, more preferably satisfies the relationship θ2≤45° or θ2≥135°, and even more preferably satisfies the relationship θ2≤30° or θ2≥150°.

Also, as shown in FIG. 12, among the ribs 25, the ribs 25 on the heel-side having a longer length in the face-back direction than the other ribs 25. Accordingly, an excessive increase in the restitution factor on the heel side is prevented. The ball hitting pitch decreases if the heel-side portion of the face portion 11 flexes too much, and therefore the ribs 25 on the heel-side have a longer length in order to avoid this decrease, and obtain a comfortably high ball hitting pitch.

A line L2 shown as a dashed-dotted line in FIG. 12 indicates the position of the apex portion of the crown portion 2. The line L2 is a line that constitutes the ridge line of the apex portion when viewing the head 100 in the reference state in the face-back direction from the face portion 11 side. As can be seen from this figure, in the present embodiment, the boundary line L1 and the thickness transition portion 41*a* rearward thereof extend from the heel side to the toe side so as to approach the line L2 that defines the apex portion of the crown portion 2. In general, the apex portion of the crown portion 2 tends to become the origin of bending, but as described above, in the present embodiment, the boundary line L1 between the thick region 40 and the thin region 41 is defined in the vicinity of the line L2. As a result, it is possible to amplify flexure originating at the apex portion of the crown portion 2. As shown in FIG. 12, in the present embodiment, the ridge line of the apex portion extends from the front side to the rear side as it extends from the heel side to the toe side, and the boundary line L that follows the ridge line of the apex portion also extends in a similar manner. However, the extending directions of the ridge line of the apex portion and the boundary line L are not limited to these directions, and they may, for example extend so as to extend from the front side to the rear side as they extend from the toe side to the heel side.

Also, in the case where the thickness w1 of the upper rising portion 30 and the thickness w2 of the thick region 40 satisfy the relationship w2+1 mm>w1>w2−1 mm, more preferably in the case where they satisfy the relationship w2+0.8 mm>w1>w2−0.8 mm, and even more preferably in the case where they satisfy the relationship w2+0.6 mm>w1>w2−0.6 mm, flexure originating at the connection portion of the upper rising portion 30 and the thick region 40 relatively increases.

4. Thickness Structure of Face Portion

Next, the thickness structure of the face portion 11 that contributes to an increase in the flight-distance will be described. The front surface side of the face portion 11 that serves as the ball hitting face is formed so as to be flat. On the other hand, unevenness is formed on the rear surface side of the face portion 11. In other words, the face portion 11 is constituted by multiple regions having different thicknesses.

Figure 14:
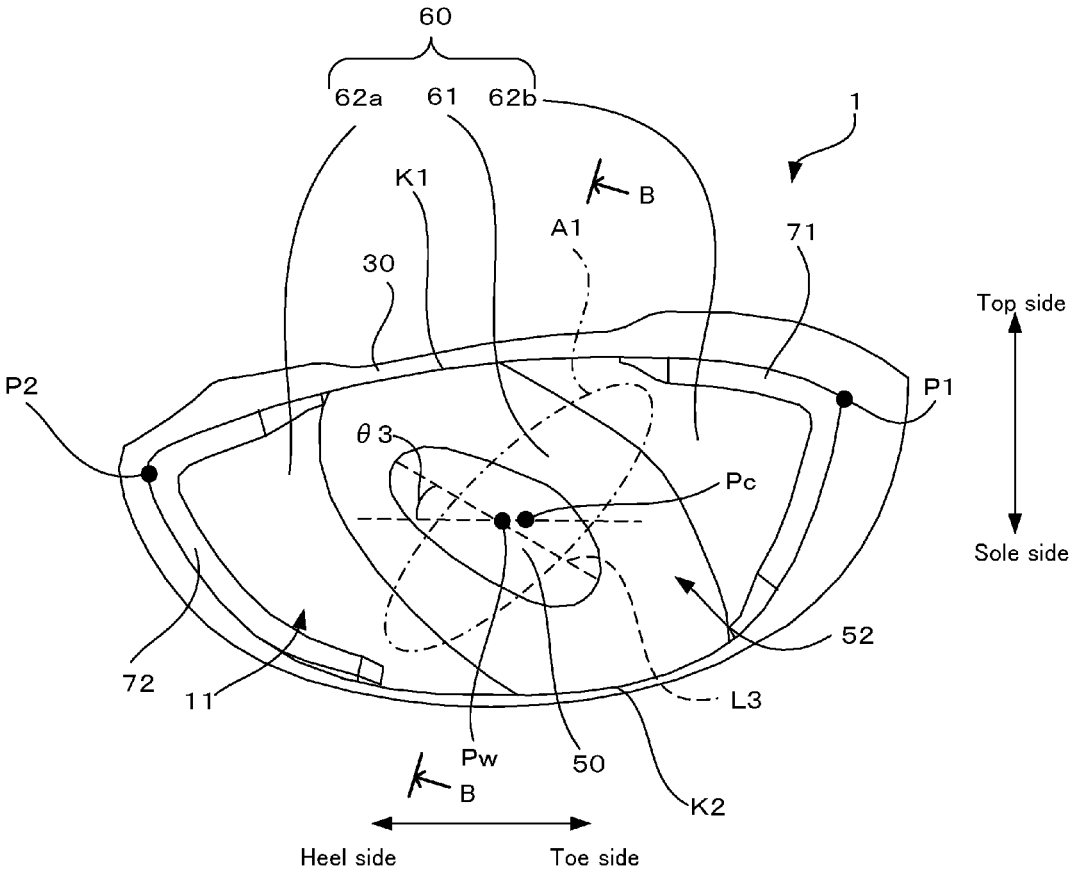
FIG. 14 is a rear view of a face member in the reference state.

FIG. 14 is a rear view of the face member 1 in the reference state. As shown in this figure, a thick central portion 50 is formed in the face portion 11, and a thin peripheral region 60 is formed so as to surround the central portion 50. The peripheral region 60 has a roughly ring-shaped transition portion 61 that surrounds the central portion 50 and comes into contact with the central portion 50, and thin portions 62*a* and 62*b* that further surround the transition portion 61 and come into contact with the transition portion 61. The transition portion 61 is thicker than the thin portions 62*a* and 62*b*, but is thinner than the central portion 50. Also, the thin portion 62*a* is the region on the heel side of the transition portion 61, and the thin portion 62*b* is the region on the toe side of the transition portion 61. In the present embodiment, the transition portion 61 is constituted so as to gradually decrease in thickness outward from the central portion 50, that is to say toward the thin portions 62*a* and 62*b*, and this change in thickness is continuous. However, the thicknesses of the transition portion 61 may be constant, and even in the case of changing, the thicknesses may change in a non-continuous manner, such as in a stepwise manner.

Figure 15:
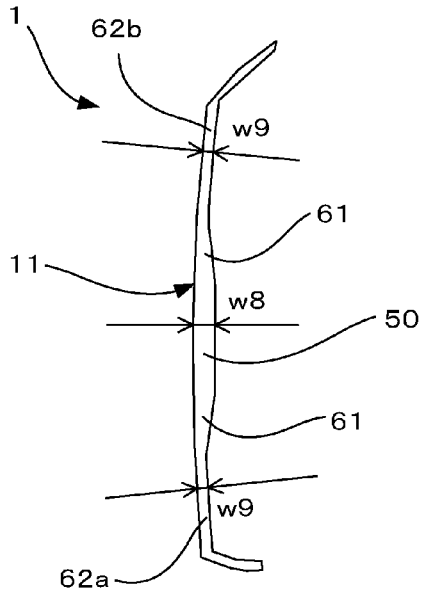
FIG. 15 is a cross-sectional view taken along line B-B in FIG. 14.

FIG. 15 is a cross-sectional view taken along line B-B in FIG. 14. In the present embodiment, a thickness w8 of the central portion 50 is roughly constant, and can be set to satisfy the relationship 2.0 mm≤w8≤4.5 mm, or more preferably satisfy the relationship 3.0 mm≤w8≤4.0 mm, for example. Also, in the present embodiment, a thickness w9 of the thin portions 62*a* and 62*b* is roughly constant and, for example, can be set to 1.5 mm or more preferably 1.8 mm≤w9≤2.6 mm. Accordingly, the central portion 50 is a low restitution area that has a relatively low restitution factor, and the thin portions 62*a* and 62*b* are high restitution areas that have a relatively high restitution factor.

Hereinafter, for the sake of convenience in the description, assuming that the head 100 is placed in the reference state, a point P1 farthest on the toe side on the peripheral edge of the face portion 11 will be referred to as the toe-side end point, and a point P2 farthest on the heel side will be referred to as the heel-side end point (see FIG. 14). Also, on the peripheral edge of the face portion 11, the top-side line extending from the toe-side end point P1 to the heel-side end point P2 will be referred to as a top line K1, and a sole-side line extending from the toe-side end point P1 to the heel-side end point P2 will be referred to as a sole line K2.

As shown in FIG. 14, the central portion 50 includes a face center Pc and a sweet spot located in the vicinity thereof, and is roughly elliptical overall. Note that the sweet spot is the foot of the perpendicular line from the center of gravity of the golf club head 100 to the face portion 11. Also, the central portion 50 extends in the shape of an "I" so as to be inclined from the top side to the sole side along the direction from the heel side to the toe side. Let L3 be a line segment that passes through a center Pw (geometrical center) of the central portion 50, overlaps the central portion 50, and has a maximum length. An angle θ3 formed by the line segment L3 and the toe-heel direction can be set to 5°≤θ3<90°, for example. More preferably, it can be set to 30°≤θ3≤50°. Note that in the present embodiment, the face center Pc is specified as follows. Specifically, first, in the face portion, a maximum width Wx in the toe-heel direction is determined, and a central position Px in the toe-heel direction at the maximum width Wx is determined. Then, at the position Px, a central point Py in the up-down direction of the face portion is determined, and this point Py is defined as a face center Pc. Note that FIG. 11 is a cross-sectional view that passes through the face center Pc.

Also, the transition portion 61 surrounds the entirety of the central portion 50, and a central region 52 made up of the central portion 50 and the transition portion 61 also has a roughly elliptical shape overall. Also, the central region 52 also extends in the shape of an "I" so as to be inclined from the top side to the sole side along the direction from the heel side to the toe side. The transition portion 61 reaches the top line K1 and the sole line K2. In other words, the central region 52 extends over the entire face portion 11 in the top-sole direction, but is concentrated relatively in the central portion of the face portion 11 in the toe-heel direction, and does not reach the heel-side end point P2. Note that in the present embodiment, the geometrical center of the central region 52 is roughly equivalent to the face center Pc.

If the thickness of the face portion 11 rapidly decreases in the vicinity of the boundary line between the face portion 11 and the rising portion 12, stress becomes concentrated in this thin portion, and there is a risk of having an effect on the durability of the face portion 11. However, in the present embodiment, the transition portion 61 is continuous with the top line K1 and the sole line K2 as described above. In other words, the central portion 50 does not suddenly end in the vicinity of the rising portion 12, nor does the thickness of the face portion 11 rapidly decrease. The strength of the face member 1 is therefore ensured.

Also, generally, on the face surface, hit points are distributed along a straight line that passes through the face center Pc and is inclined from the sole side to the top side along the direction from the heel side toward the toe side. This hit point distribution region is a region surrounded by a dashed-dotted line A1 in FIG. 14, for example. Accordingly, it can be said that the aforementioned central portion 50 or central region 52 spreads out so as to intersect the hit point distribution region. As a result, the thick central portion 50 or central region 52 can be caused to flex in the direction of the spread of the hit point distribution region, and it is possible to increase the restitution factor in the hit point distribution region.

Also, in the present embodiment, as shown in FIG. 14, the center Pw of the central portion 50 is located on the heel side relative to the face center Pc. In other words, the central portion 50 is arranged inside the face portion 11, at a location toward the heel side in the central region 52. As a result, it is possible to prevent an excessive rise in the restitution factor in the face portion 11.

Also, generally, the closer to the center of gravity of the head 100, the higher the restitution factor is anticipated to be during ball hitting. Accordingly, in the configuration of the present embodiment, the sweet spot is located on the heel side relative to the face center Pc on the face surface. Accordingly, it is possible to raise the restitution factor of the heel-side portion on the face portion 11.

Also, as shown in FIG. 14, a V-shaped slit (groove) 71 that is approximately centered on the toe-side end point P1 and extends along the boundary line between the face portion 11 and the rising portion 12 is formed on the inner surface of the face portion 11. Similarly, a V-shaped slit (groove) 72 that is approximately centered on the heel-side end point P2 and extends along the boundary line between the face portion 11 and the rising portion 12, is formed on the heel side as well. In other words, regions thinner than the thin portions 62*a* and 62*b* are formed in the vicinity of the toe-side end point P1 and the heel-side end point P2. With the slits 71 and 72, it is possible to increase the restitution factor in the toe-side and heel-side portions in particular. Accordingly, it is possible to prevent the high restitution area from being concentrated in the central region on the face surface, and to expand the high restitution area. As a result, it is possible to increase the flight-distance even if the ball is not grabbed at the central region of the face portion 11 in a mishit or an intentional shot, for example.

5. Variations

Although a second embodiment of the present invention has been described above, the present invention is not limited to the second embodiment, and various modifications can be made without departing from the gist of the invention. The following are examples of modifications that can be made. The main portions of the following variations can be combined as appropriate.

5-1

In the second embodiment, the high restitution area on the face portion 11 is expanded by setting the rigidity of the first central portion 20*c* higher than the rigidity of the first toe-side portion 20*a* and the first heel-side portion 20*b*. However, the method for realizing this function is not limited to the method described above. For example, one rib 21 may be formed on the first central portion 20*c*, and the extending direction of the rib 21 can also be set as desired. Also, the ribs 21 are not limited to being straight lines, and may be curved. Instead of or in addition to the ribs 21, projecting portions that are circular, quadrilateral, or the like can also be formed. Moreover, instead of or in addition to forming the ribs 21 in the first central portion 20*c*, the first central portion 20*c* can be formed thicker than the first toe-side portion 20*a* and the first heel-side portion 20*b*. Furthermore, in order to realize this function, as long as the rigidity of the first central portion 20*c* is set higher than the rigidity of the first toe-side portion 20*a* and the first heel-side portion 20*b*, ribs (projecting portions) can be provided on not only the first central portion 20*c*, but also the first toe-side portion 20*a* and the first heel-side portion 20*b*. In this case, it is possible to, for example, provide the ribs (projecting portions) formed on the first central portion 20*c* so as to be more concentrated than those on the first toe-side portion 20*a* and the first heel-side portion 20*b*.

5-2

Figure 16:
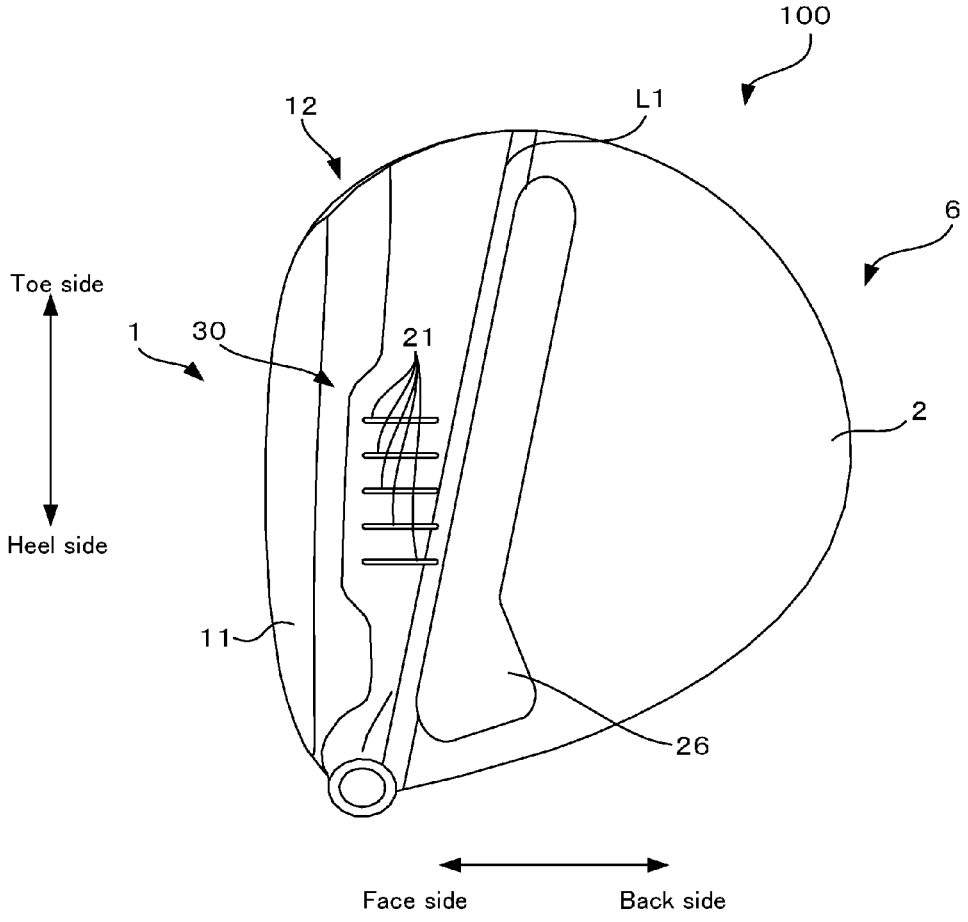
FIG. 16 is a plan view of the golf club head in the reference state, showing the structure of the inner surface of the crown portion according to a variation.

In the configuration of the second embodiment, the ribs 25 are used to increase the rigidity at the front edge of the thin portion 41*b* and cause bending to originate in the vicinity of the boundary line L1. However, the method for realizing this function is not limited to the method described above. For example, the extending direction of the ribs 25 can be set as desired, and the ribs 25 may be curved instead of being straight lines. Also, instead of or in addition to the ribs 25, it is possible to form protruding portions that are circular, elliptical, quadrilateral, or the like. For example, as shown in FIG. 16, it is possible for the thick region 26 to be a band-shaped region in which the ribs 25 are formed in the second embodiment.

5-3

In the second embodiment, sections 2, 3, and 4 describe the structure in the vicinity of the connection portion of the face member 1 and the head body 6, as well as the thickness structures of the crown portion 2 and the face portion 11. These structures each contribute to an increase in the flight-distance, and these features can each be independently applied in a golf club head. For example, the above-described thickness structure of the crown portion 2 is also applicable to a golf club head that includes a face member that does not have the rising portion 12 and is not cup face-shaped.

5-4

Figure 17:
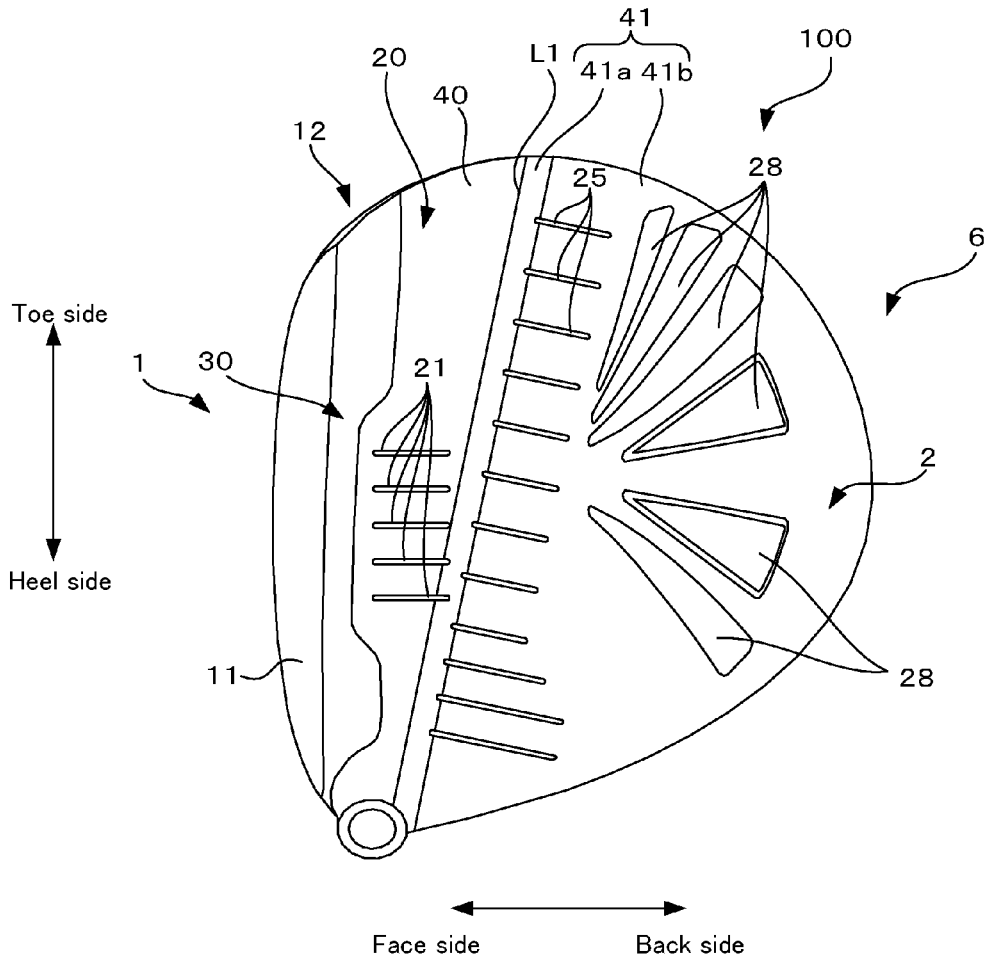
FIG. 17 is a plan view of the golf club head in the reference state, showing the structure of the inner surface of the crown portion according to another variation.

As shown in FIG. 17, raised portions 28 may be formed on the rear end portion of the thin portion 41*b*. These raised portions 28 can take various aspects. They can have an approximately triangular shape as shown in FIG. 17, and one or more can be formed. Furthermore, as shown in FIG. 17, the raised portions 28 can be arranged in a radiating manner at positions avoiding the heel-side portion, in an aspect in which their vertices are gathered together at approximately the same point. Accordingly, it is possible to reduce the weight of the head 100, and thus it is possible to increase the moment of inertia.

The invention claimed is:

1. A golf club head comprising:

a golf club head body having a crown portion and a sole portion, and having an opening surrounded by the crown portion and the sole portion; and a face member that covers the opening of the golf club head body, wherein the face member is shaped as a cup having a face portion formed in a plate shape and a peripheral portion extending from a peripheral edge of the face portion, a portion of the peripheral portion of the face member that extends along the crown portion includes a first toe-side edge portion arranged on a toe side, a first heel-side edge portion arranged on a heel side, and a first central edge portion arranged between the first toe-side edge portion and the first heel-side edge portion, a length of protrusion of the first central edge portion from the face portion is shorter than a length of protrusion of the first toe-side edge portion and the first heel-side edge portion from the face portion, a thickness of at least a portion of the first central edge portion is larger than a thickness of the first toe-side edge portion and the first heel-side edge portion, and a protruding portion extending along the opening is formed on the crown portion of the golf club head body for joining to the first central edge portion.

2. The golf club head according to claim 1, wherein an opening-side edge portion of the crown portion of the golf club head body includes a second toe-side edge portion, a second heel-side edge portion, and a second central edge portion for joining to the first toe-side edge portion, the first heel-side edge portion, and the first central edge portion respectively, and a thickness of at least a portion of the second central edge portion is larger than a thickness of the second toe-side edge portion and the second heel-side edge portion.

3. The golf club head according to claim 2, wherein the thickness progressively decreases from the first and second central edge portions to the first and second toe-side edge portions and the first and second heel-side edge portions.

4. The golf club head according to claim 2, wherein thicknesses of the first and second toe-side edge portions are the same, thicknesses of the first and second heel-side edge portions are the same, and thicknesses of the first and second central edge portions are the same.

5. The golf club head according to claim 1, wherein the thickness progressively decreases from the first central edge portion to the first toe-side edge portion and the first heel-side edge portion.

6. The golf club head according to claim 1, wherein the crown portion includes a peripheral edge region that extends along an inner peripheral edge of the crown portion, and an inner region surrounded by the peripheral edge region, and a thickness of at least a portion of the inner region is smaller than a thickness of the peripheral edge region.

7. The golf club head according to claim 6, wherein a first region and a plurality of second regions having a smaller thickness than the first region are provided in the inner region, the plurality of second regions are distributed so as to radiate toward a peripheral portion of the crown portion excluding the face side in the face-back direction, from respective origins that are located in a vicinity of a face side in a face-back direction in a range of within 35 mm from a center of gravity of the golf club head as a center in a toe-heel direction in a plan view, and portions of the first region arranged between adjacent second regions increase in width from the origin side toward the peripheral portion side.

8. The golf club head according to claim 7, wherein a portion of the peripheral edge region that opposes the first heel-side edge portion has a longer length in the face-back direction with increasing proximity to the heel side.

9. The golf club head according to claim 7, wherein a portion of the peripheral edge region that opposes the first toe-side edge portion has a longer length in the face-back direction with increasing proximity to the toe side.

* * * * *